US012588793B2

(12) United States Patent
Shim et al.

(10) Patent No.: US 12,588,793 B2
(45) Date of Patent: Mar. 31, 2026

(54) ROBOT CLEANER, CONTROL SYSTEM OF ROBOT CLEANER AND CONTROL METHOD OF ROBOT CLEANER

(71) Applicant: LG ELECTRONICS INC., Seoul (KR)

(72) Inventors: Inbo Shim, Seoul (KR); Hwan Yoo, Seoul (KR); Seungjin Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 523 days.

(21) Appl. No.: 18/014,259

(22) PCT Filed: Jun. 10, 2021

(86) PCT No.: PCT/KR2021/007252
§ 371 (c)(1),
(2) Date: Jan. 3, 2023

(87) PCT Pub. No.: WO2022/005039
PCT Pub. Date: Jan. 6, 2022

(65) Prior Publication Data

US 2023/0255432 A1 Aug. 17, 2023

(30) Foreign Application Priority Data

Jul. 1, 2020 (KR) ..... 10-2020-0081011

(51) Int. Cl.
*A47L 11/40* (2006.01)

(52) U.S. Cl.
CPC ..... *A47L 11/4011* (2013.01); *A47L 11/4038* (2013.01); *A47L 2201/06* (2013.01)

(58) Field of Classification Search
CPC ..... A47L 11/4011; A47L 11/4038; A47L 2201/00; A47L 2201/06
See application file for complete search history.

(56) References Cited

U.S. PATENT DOCUMENTS 5,995,884 A * 11/1999 Allen ..... G05D 1/0225 701/25

FOREIGN PATENT DOCUMENTS

| | | | |
|---|---|---|---|
| CN | 104932495 | A | 9/2015 |
| CN | 105310604 | A | 2/2016 |
| CN | 106200671 | A | 12/2016 |
| CN | 108209758 | A | 6/2018 |
| CN | 109688884 | A | 4/2019 |
| CN | 110833361 | A | 2/2020 |
| JP | 2018-196514 | A | 12/2018 |

(Continued)

*Primary Examiner* — C. A. Rivera
(74) *Attorney, Agent, or Firm* — Birch, Stewart, Kolasch & Birch, LLP

(57) ABSTRACT

The present invention relates to a robot cleaner, a control system of a robot cleaner and a control method of a robot cleaner, and the invention includes a robot cleaner that stores a map including information on a drivable area of a cleaning area and drives in the cleaning area and a terminal that inputs a cleaning command to the robot cleaner, the terminal setting a virtual designated area on the map in response to a user input, the robot cleaner moving to the designated area and driving within the designated area when the designated area is set from the terminal, and thus, the invention has the effect of intensively cleaning the designated area arbitrarily designated by a user.

6 Claims, 21 Drawing Sheets

(56) References Cited

FOREIGN PATENT DOCUMENTS

| | | | | | |
|---|---|---|---|---|---|
| JP | 3224145 | U | | 11/2019 | |
| KR | 20150009413 | A | * | 1/2015 | ..... A47L 9/2857 |
| KR | 10-2015-0028152 | A | | 3/2015 | |
| KR | 10-2017-0048815 | A | | 5/2017 | |
| KR | 10-2017-0077756 | A | | 7/2017 | |
| KR | 10-2019-0088691 | A | | 7/2019 | |
| KR | 102021827 | B1 | * | 9/2019 | ..... A47L 11/4038 |
| KR | 10-2019-0119234 | A | | 10/2019 | |
| KR | 20190119234 | A | * | 10/2019 | ..... B25J 11/0085 |
| TW | I671054 | B | | 9/2019 | |
| TW | 202010465 | A | | 3/2020 | |

* cited by examiner

[FIG. 1]
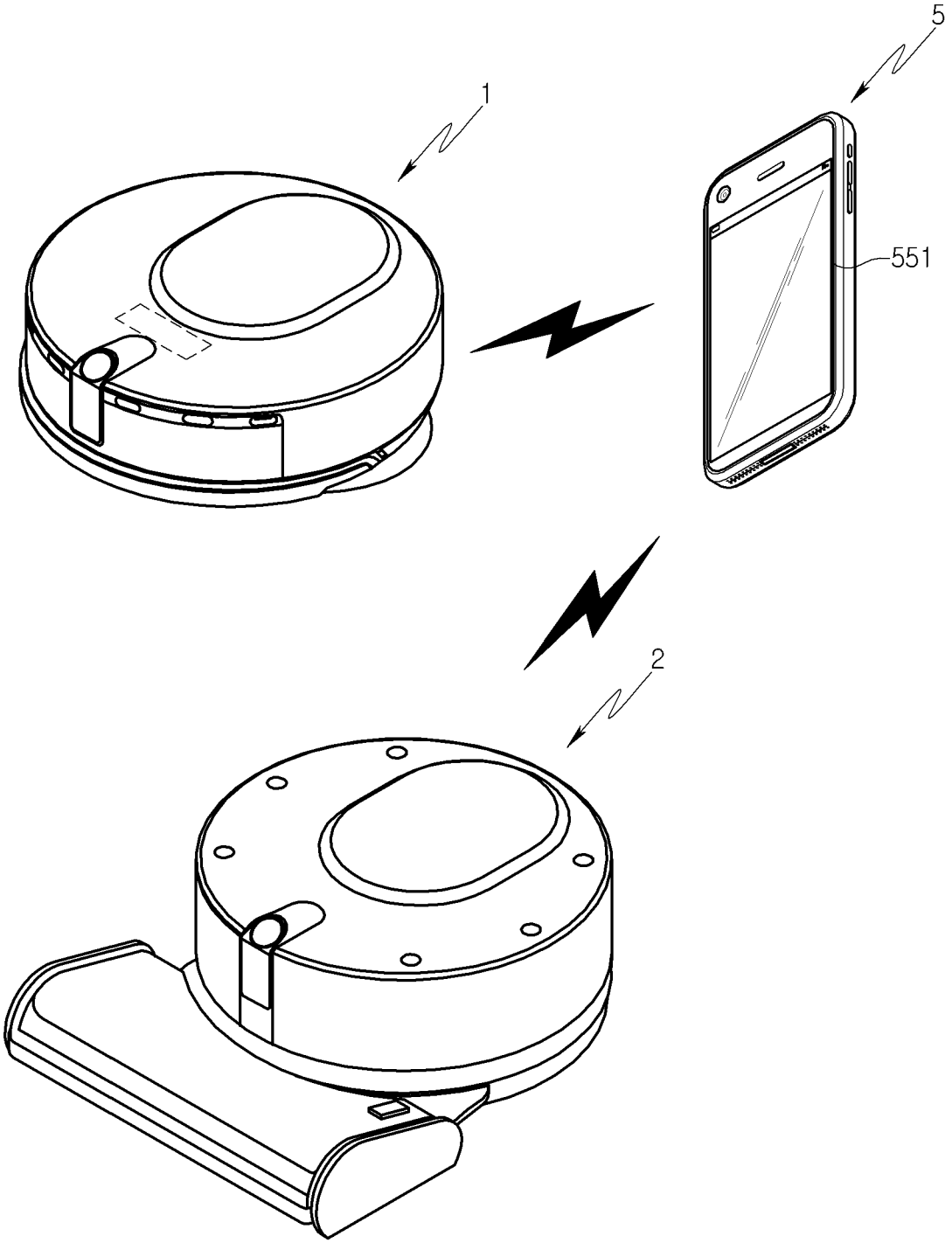

[FIG. 2a]
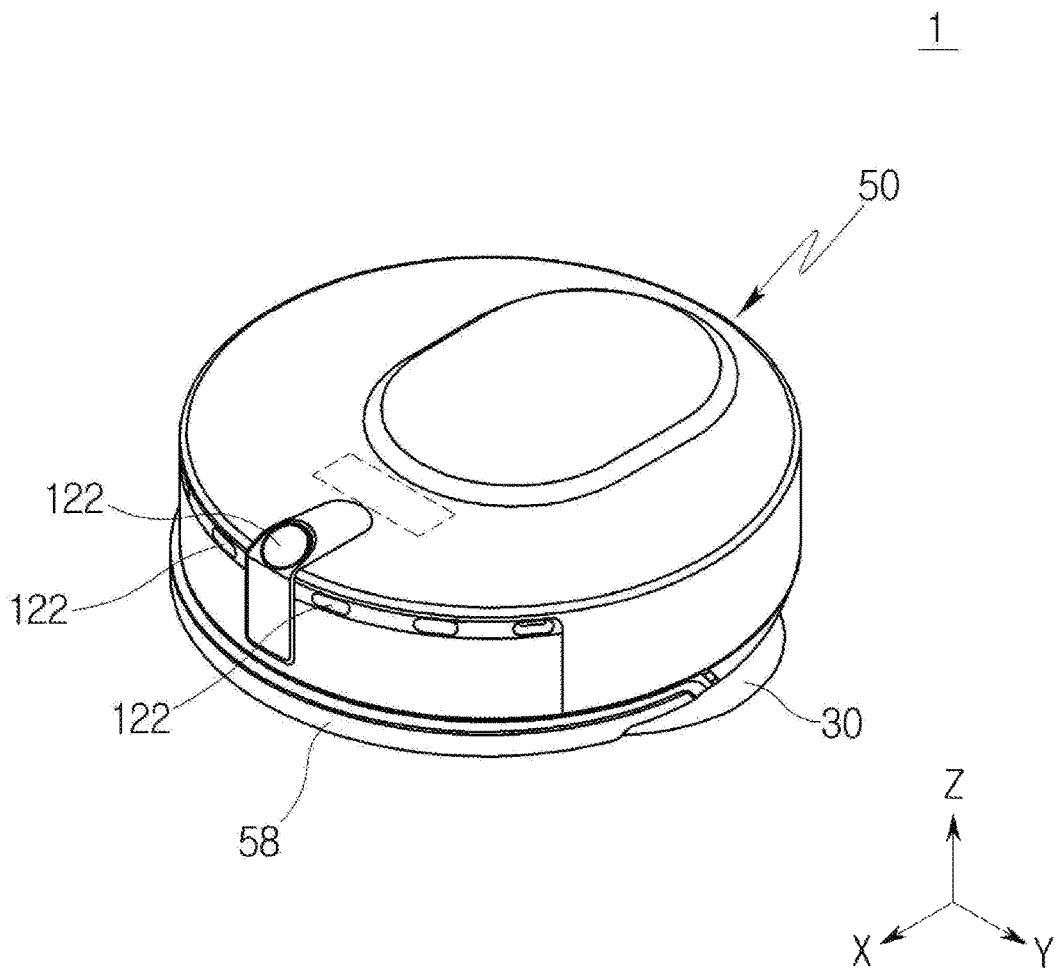

[FIG. 2b]
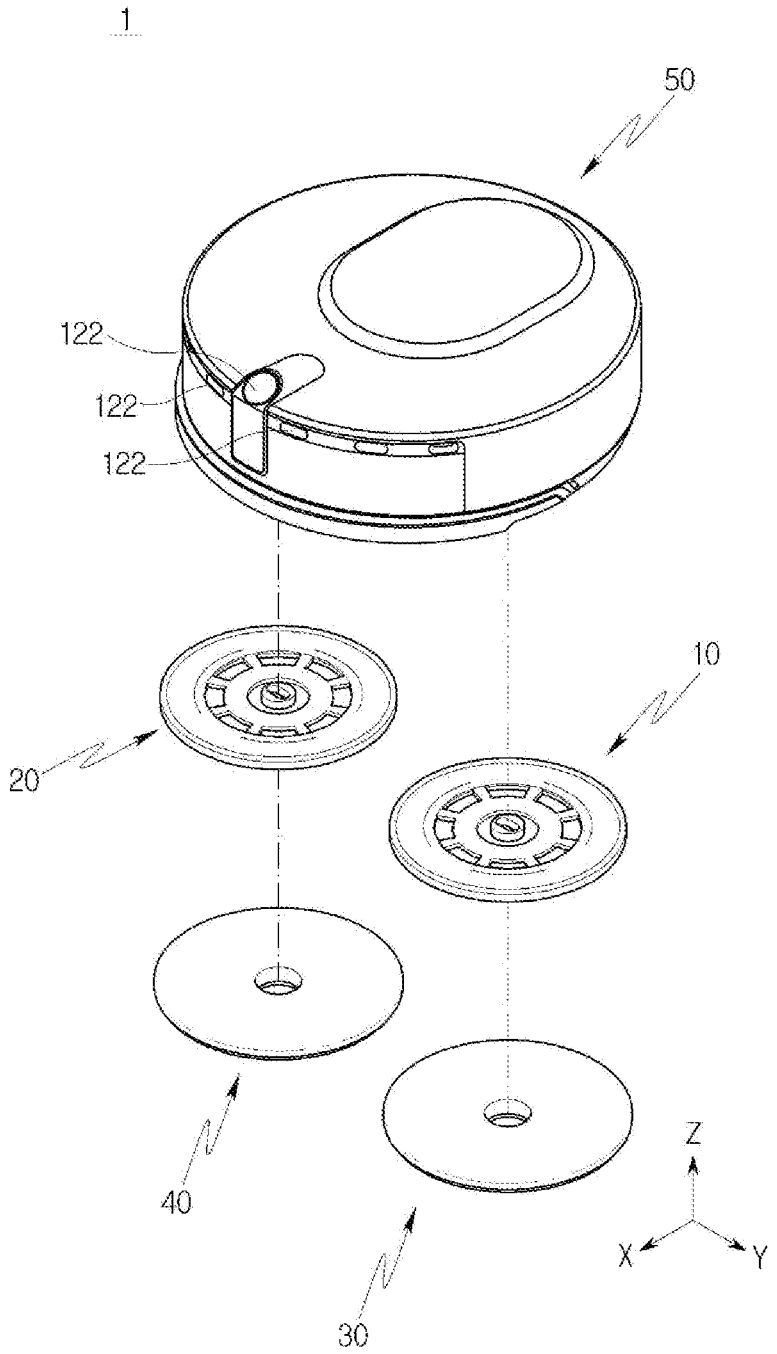

[FIG. 2c]
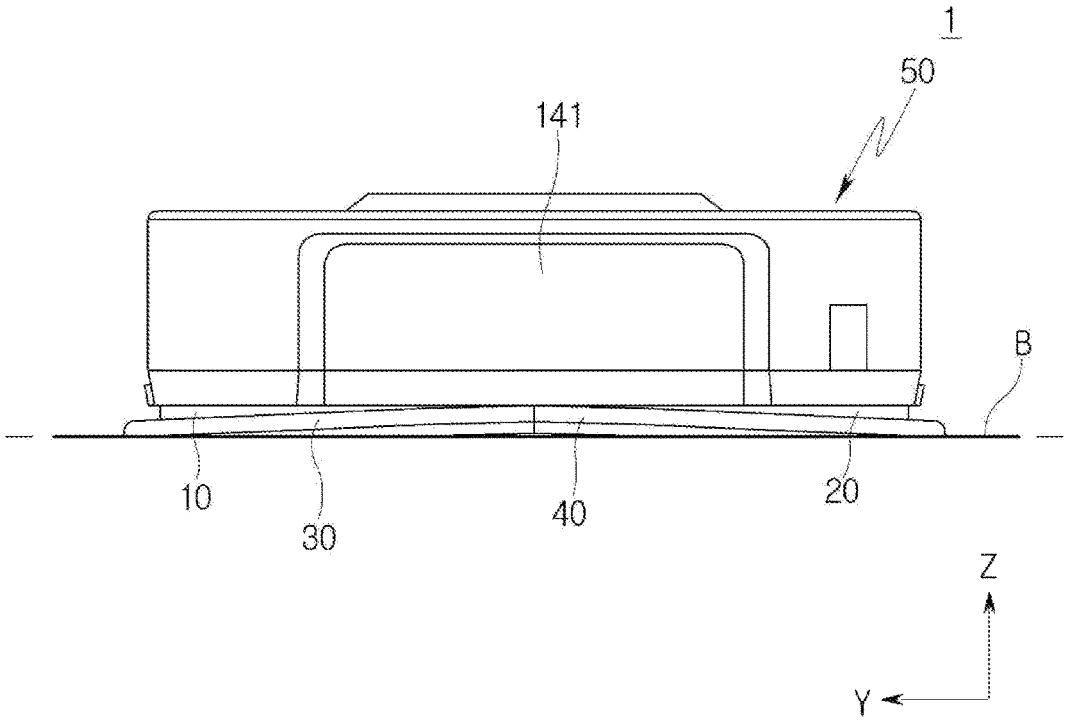

[FIG. 2d]
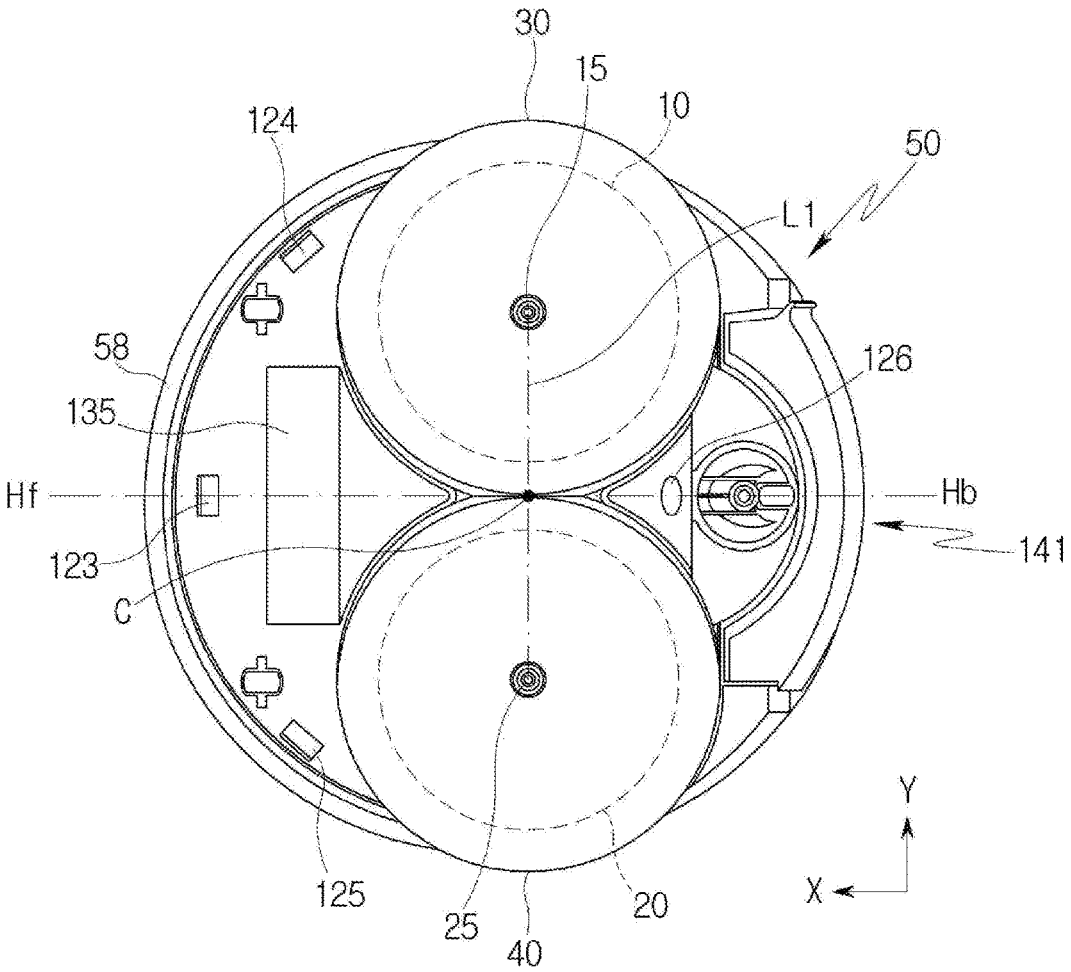

[FIG. 2e]
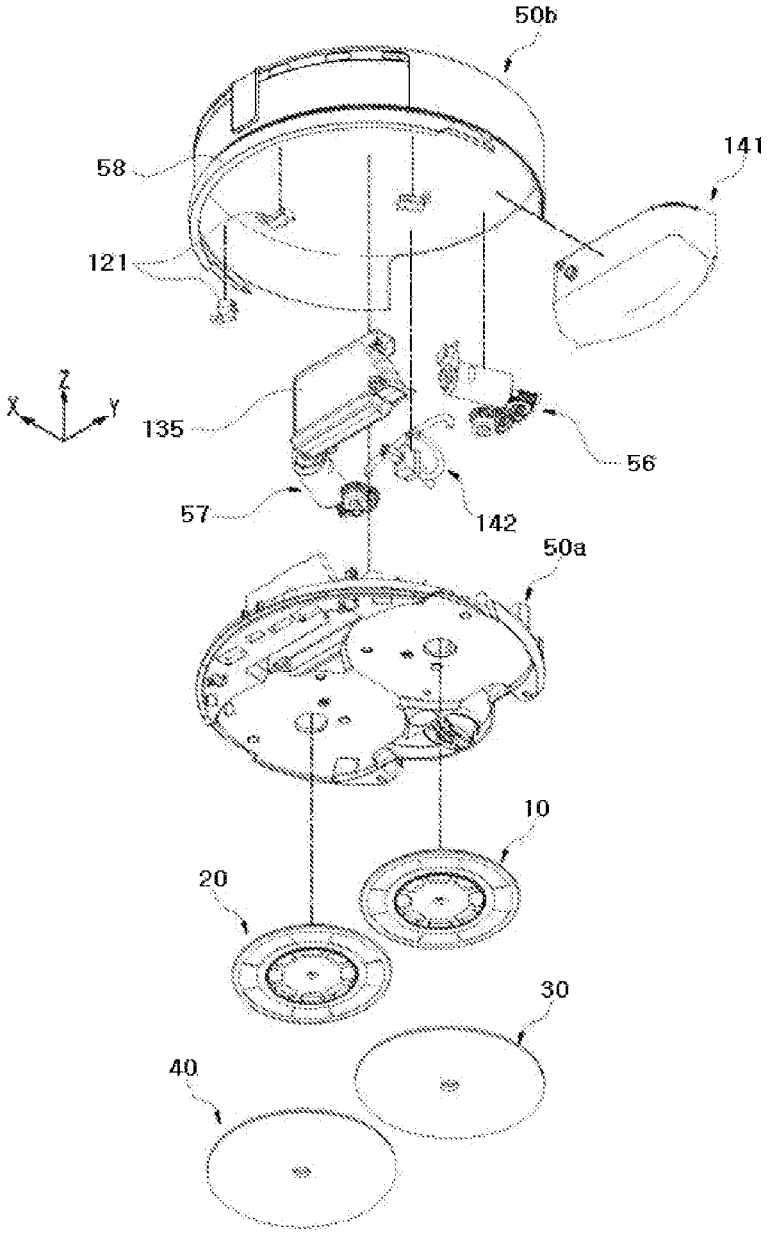

[FIG. 2f]
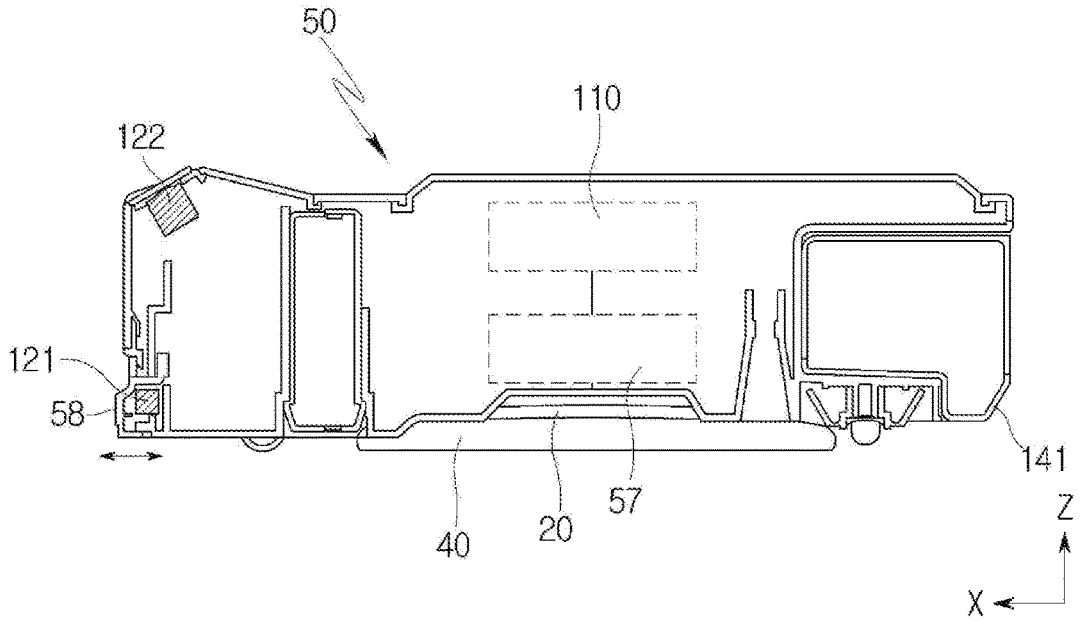

[FIG. 3]
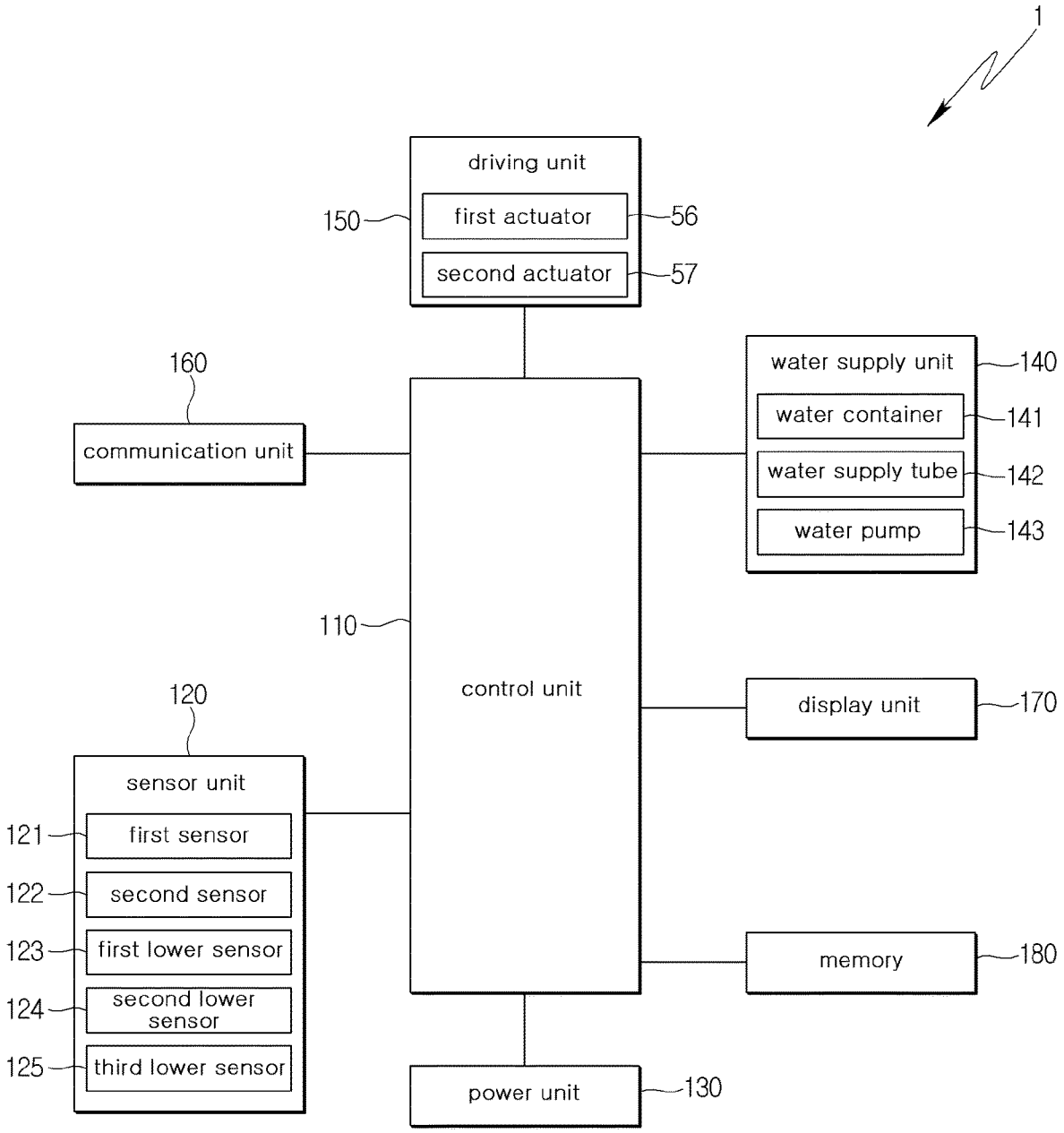

[FIG. 4a]
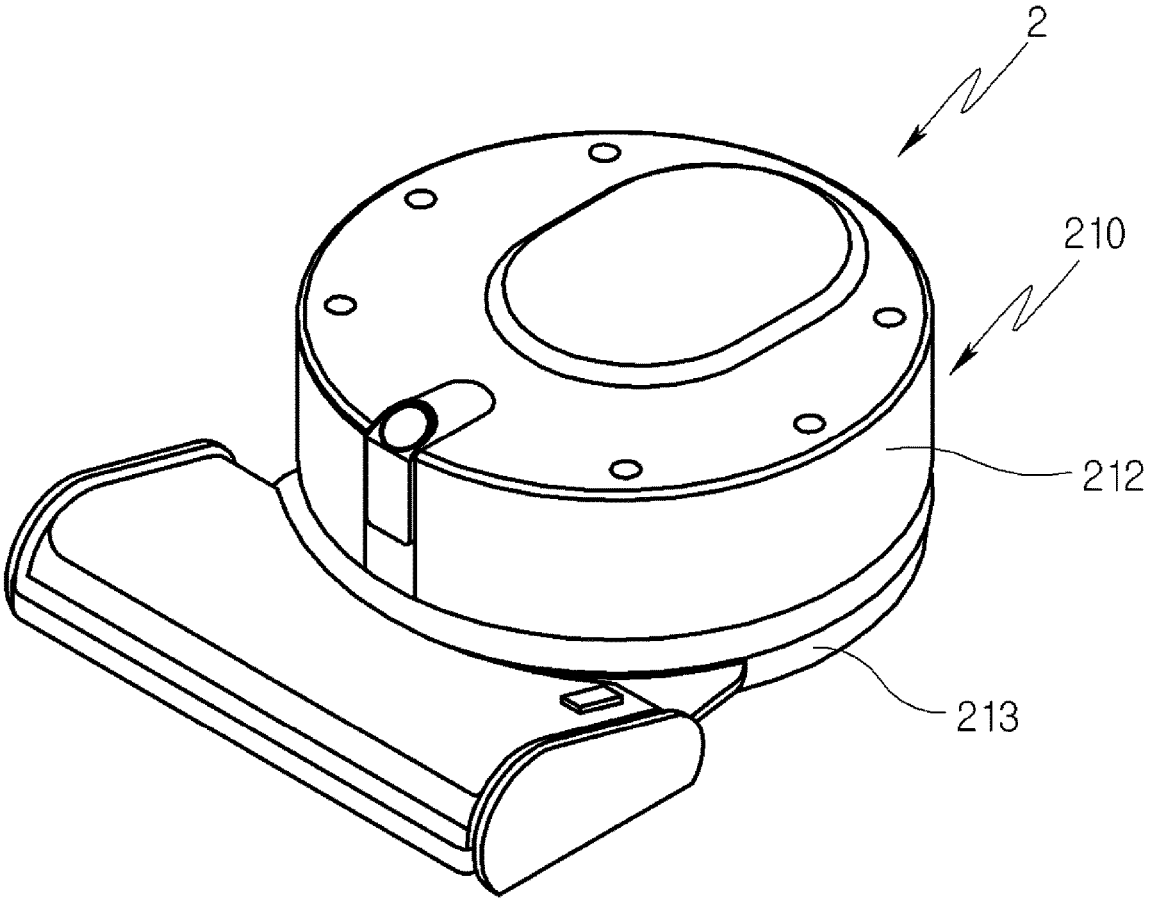

[FIG. 4b]
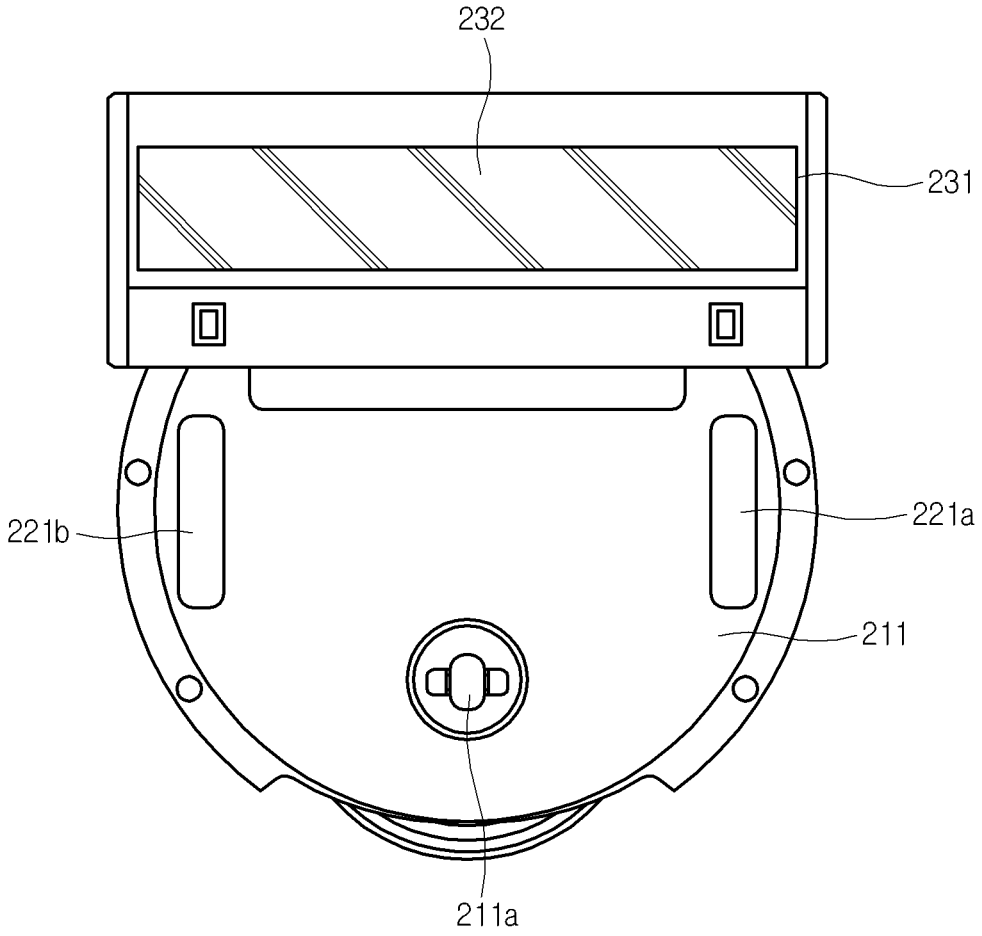

[FIG. 5]
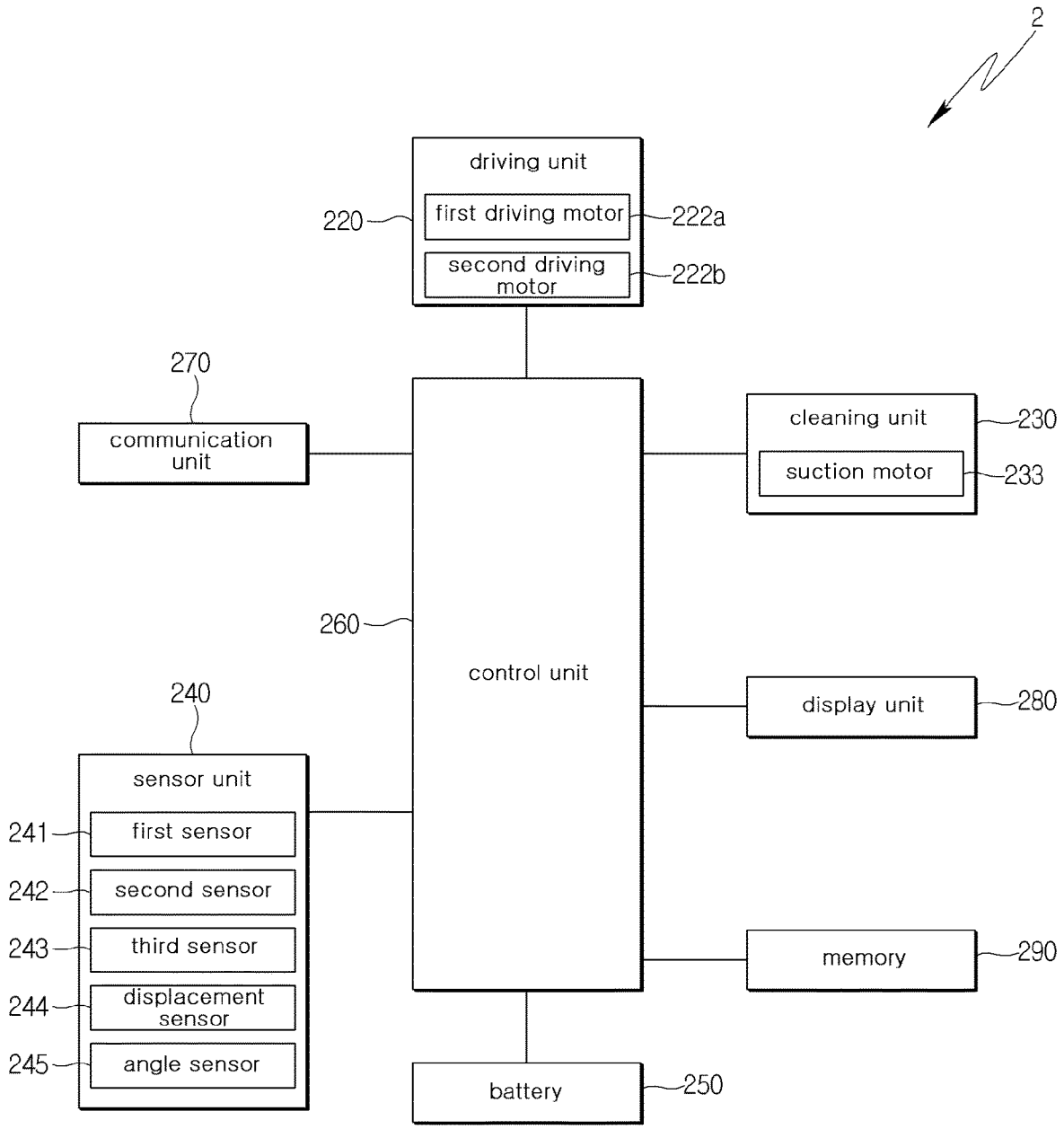

[FIG. 6]
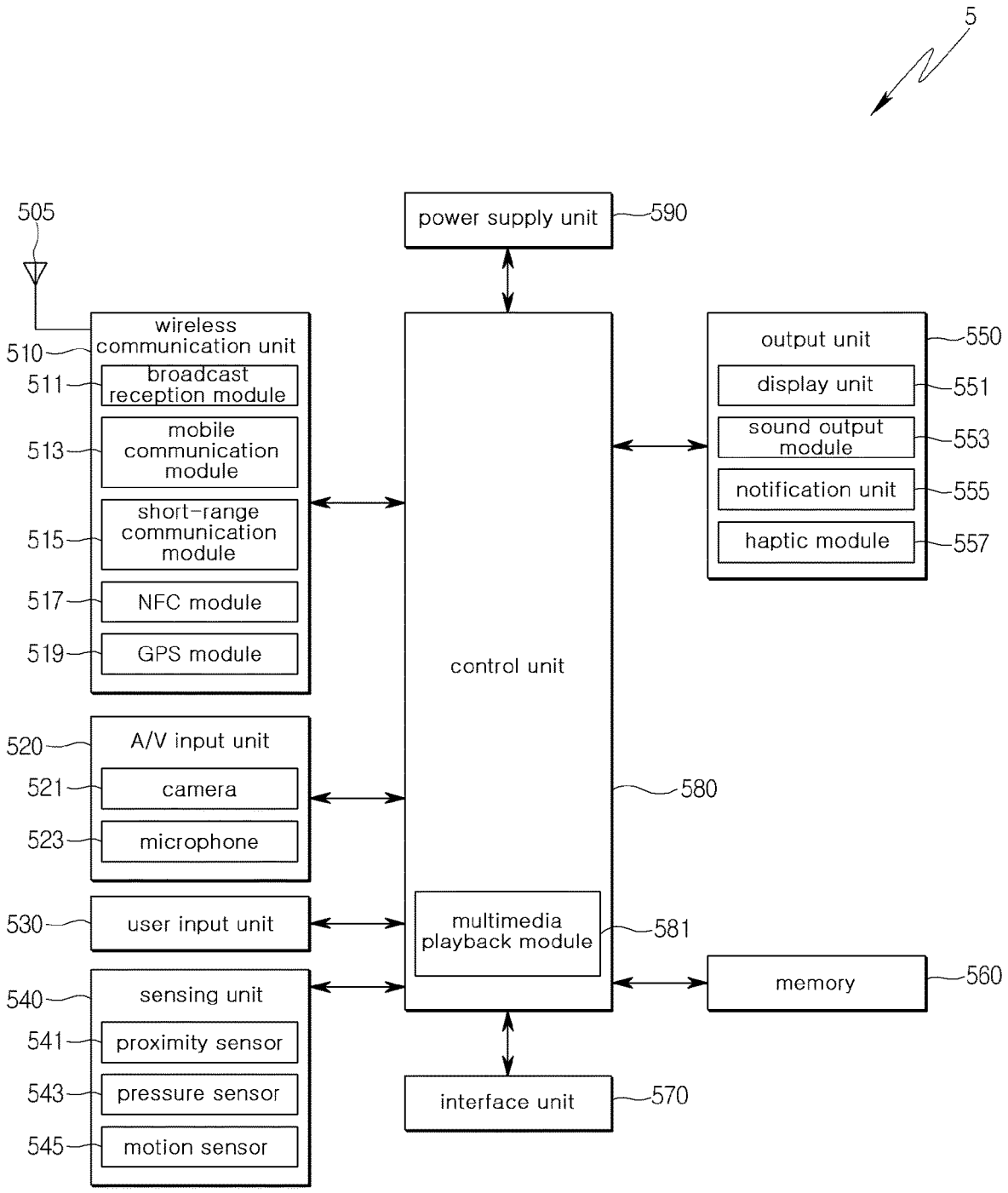

[FIG. 7]
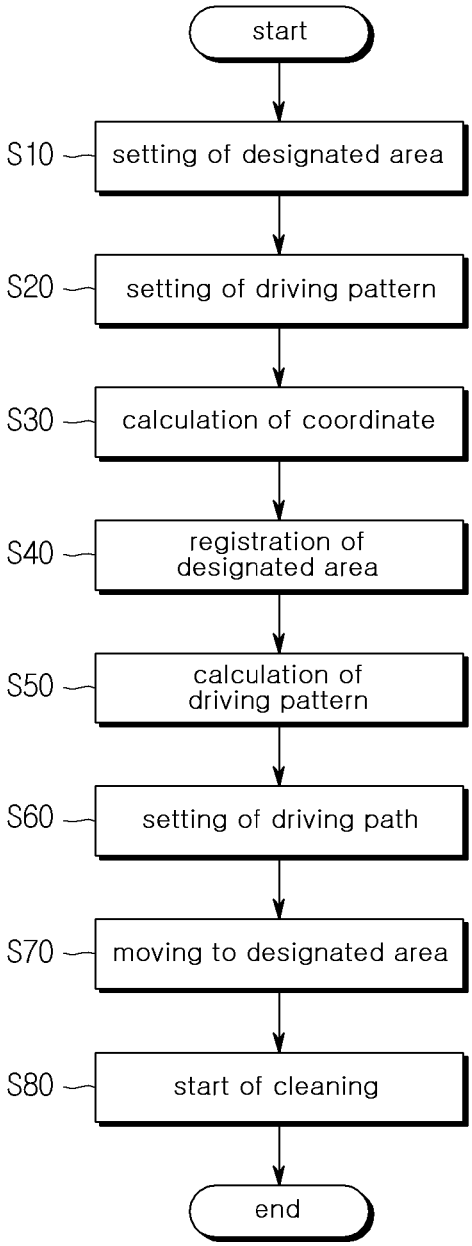

[FIG. 8]
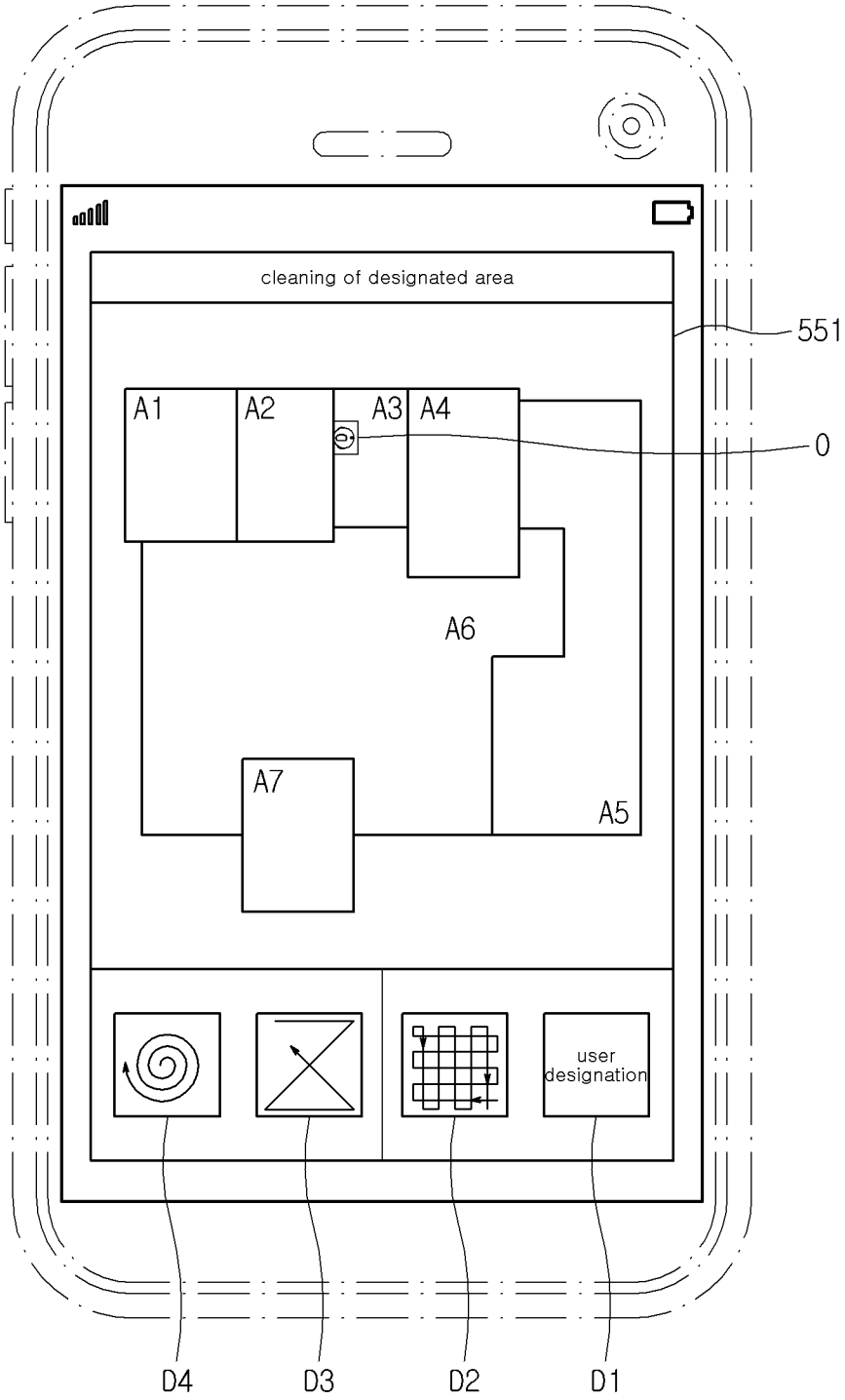

[FIG. 9]
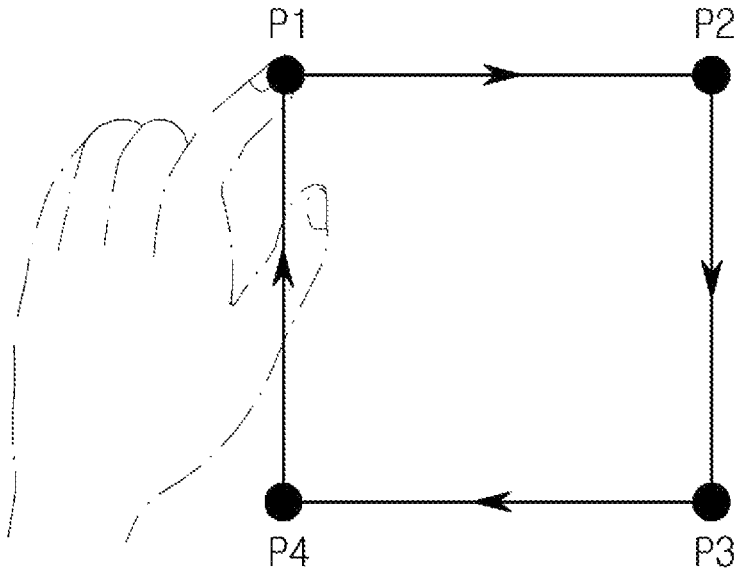

[FIG. 10]
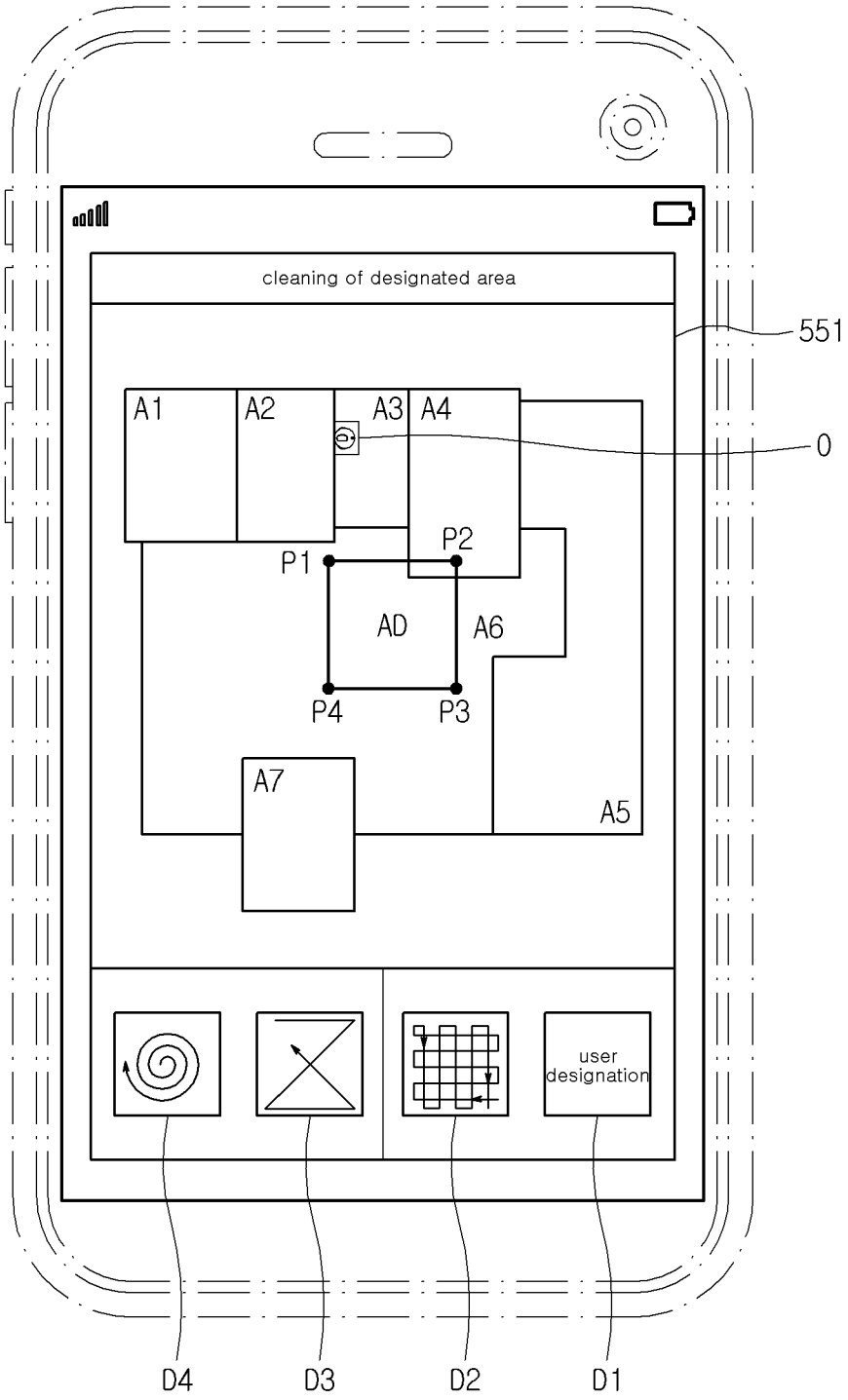

[FIG. 11]
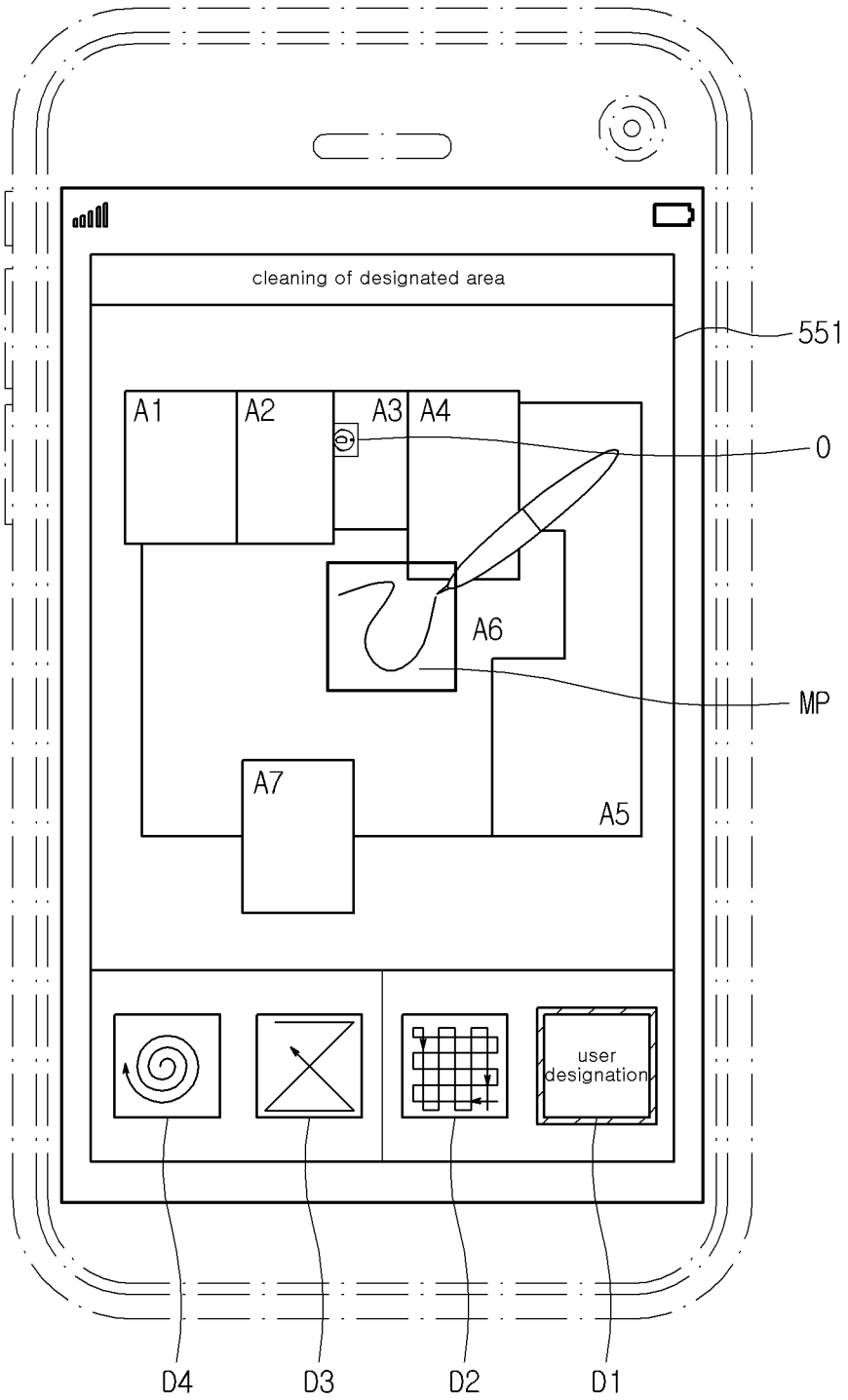

[FIG. 12]
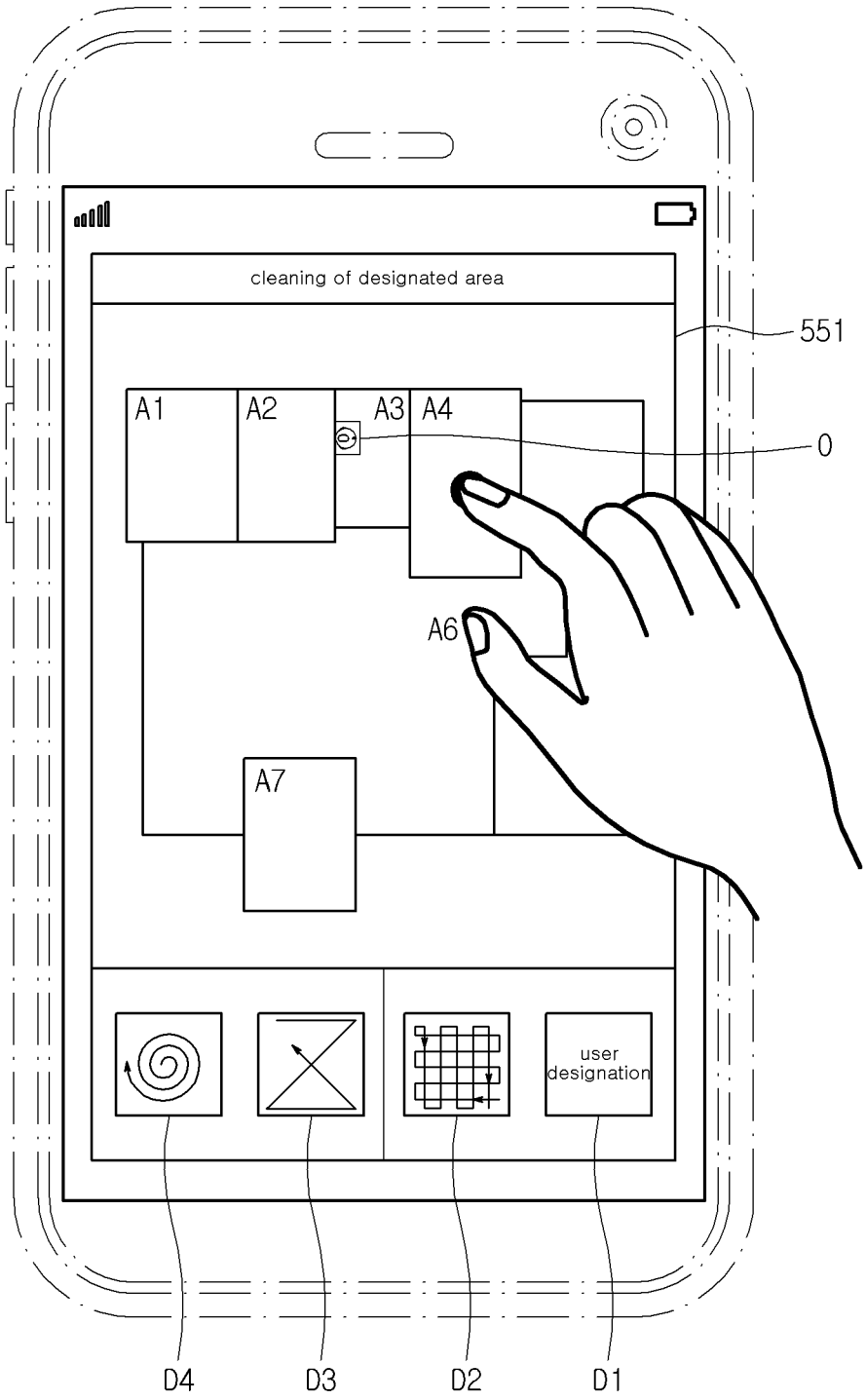

[FIG. 13]
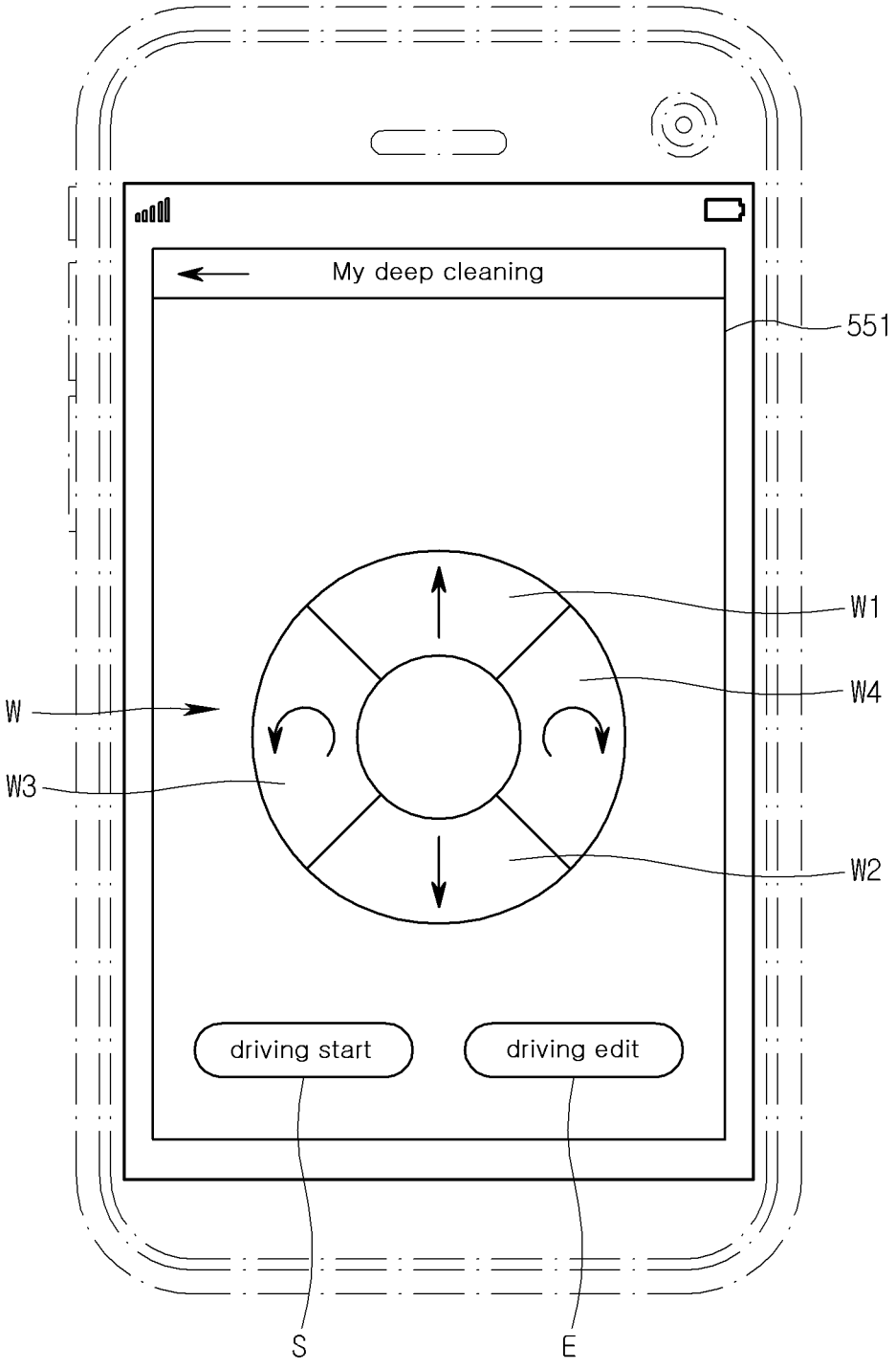

[FIG. 14]
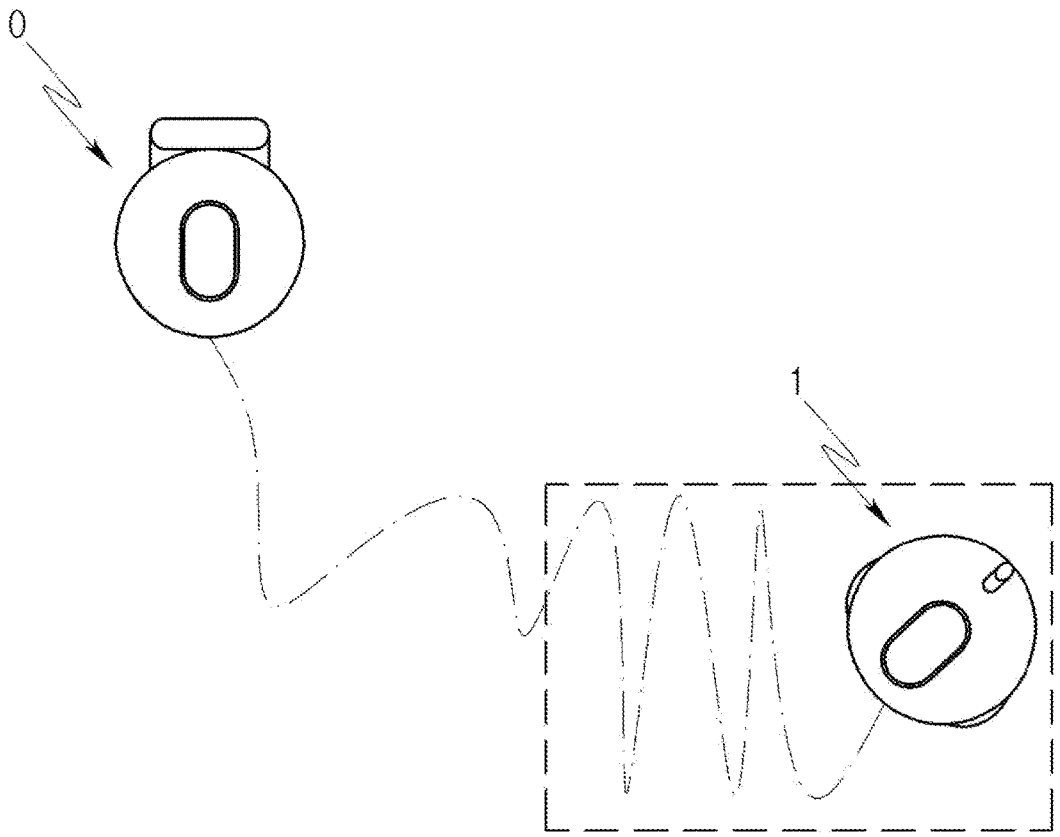

[FIG. 15]
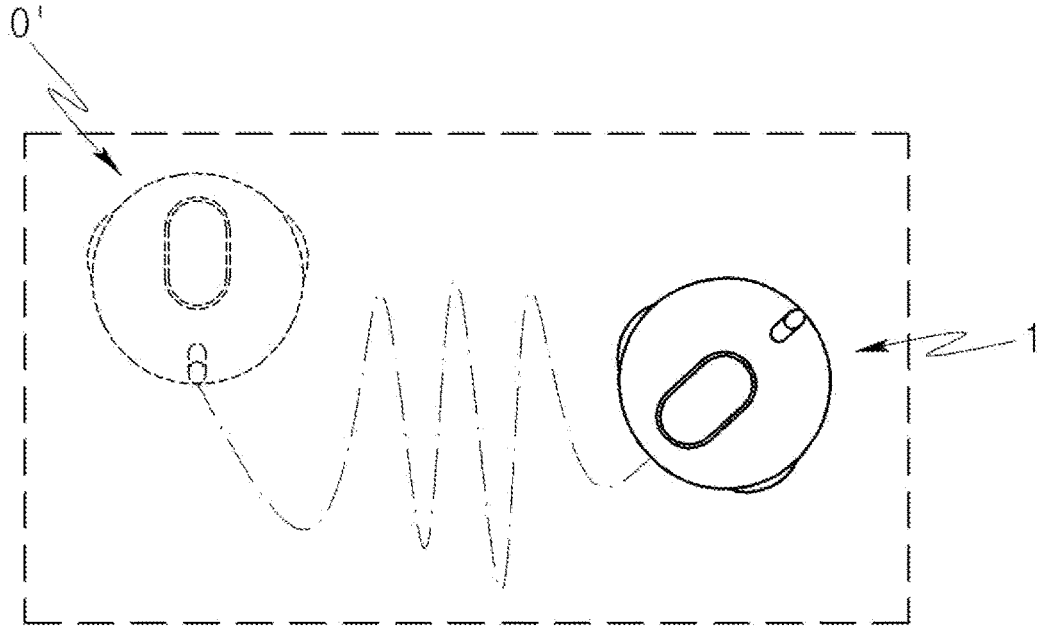

ROBOT CLEANER, CONTROL SYSTEM OF ROBOT CLEANER AND CONTROL METHOD OF ROBOT CLEANER

CROSS-REFERENCE TO RELATED APPLICATIONS

This application is the National Phase of PCT International Application No. PCT/KR2021/007252 filed on Jun. 10, 2021, which claims priority to Korean Patent Application No. 10-2020-0081011 filed in the Republic of Korea on Jul. 1, 2020, the entirety of which are hereby expressly incorporated by reference into the present application.

TECHNICAL FIELD

The present invention relates to a robot cleaner, a control system of the robot cleaner, and a control method of the robot cleaner, and more particularly, to a robot cleaner capable of driving in and cleaning a floor by rotating a mop of the robot cleaner and through a friction force between the mop and the floor, a control system and a control method of a robot cleaner.

BACKGROUND ART

Recently, with the development of industrial technology, a robot cleaner that cleans while driving in an area to be cleaned by itself without user manipulation has been developed. Such a robot cleaner is provided with a sensor for recognizing a space to be cleaned, a mop for cleaning a floor surface, and the like, and can drive while wiping the floor surface of the space recognized by the sensor with the mop and the like.

Among robot cleaners, there is a wet robot cleaner that can wipe a floor surface with a mop containing moisture in order to effectively remove foreign substances strongly attached to the floor surface. The wet robot cleaner has a water tank, and is configured to supply the water contained in the water tank to the mop and to wipe the floor surface with the moisture mop, thereby effectively removing the foreign substances strongly attached to the floor surface.

In the wet robot cleaner, the mop is formed in a circular shape, and configured to wipe the floor surface by contacting the floor surface while driving. In addition, the robot cleaner may be also configured to drive in a specific direction using a friction force by a plurality of mops rotating on and contacting the floor surface.

On the other hand, the greater the frictional force between the mop and the floor surface, the stronger the mop can wipe the floor surface, so that the robot cleaner can effectively clean the floor surface.

Meanwhile, Korean Patent Application Laid-Open No. 10-2018-0085309 discloses a control method of a robot cleaner that restricts driving by setting a specific area through a terminal.

In the control method of the robot cleaner, the robot cleaner generates a map of a cleaning area in which the robot cleaner can drive, and a virtual wall is set on the map to restrict the robot cleaner's access.

However, when a deep cleaning is required for a specific area, there is a limit in that it is impossible to set such required area.

In particular, when a deep wet mop cleaning is required for a specific area, such as when a liquid is poured into a specific area, there is a limit in that sufficient cleaning cannot be performed.

DISCLOSURE

Technical Problem

The present invention is created to improve the problems of the conventional robot cleaner, the control system of the robot cleaner, and the control method of the robot cleaner as described above. An object of the present invention is to provide a robot cleaner in which a user can designates an arbitrary area for a deep cleaning, a control system of the robot cleaner, and a control method of the robot cleaner.

In addition, another object of the present invention is to provide a robot cleaner capable of driving in a pattern set by a user in a designated arbitrary area, a control system of the robot cleaner, and a control method of the robot cleaner.

Technical Solution

In order to achieve the above object, the robot cleaner according to the present invention may clean a floor surface while driving in a cleaning area according to a cleaning command input from a terminal, and include a body including a space therein for accommodating a battery, a water container, and a motor; and a pair of rotation plates that includes a lower side to which a mop facing the floor surface is coupled and is rotatably arranged on a bottom surface of the body.

In this case, when a predetermined area of the cleaning area is designated from the terminal, the robot cleaner may drive within the designated area.

In addition, when a driving pattern is set from the terminal, the robot cleaner may drive within the designated area according to the driving pattern.

The cleaning area may include a plurality of divided areas, and when a cleaning order of the divided areas is input from the terminal, the robot cleaner may drive in the divided areas according to the input order.

The robot cleaner according to the present invention may further include a memory that is arranged inside the body and stores the driving pattern.

In this case, when a stored driving pattern is selected after a predetermined area of the cleaning area is designated from the terminal, the robot cleaner may drive within the designated area according to the driving pattern.

The terminal may receive information on driving in the cleaning area from a suction cleaner including a dust inlet and a pair of wheels and driving in the cleaning area, and designate the designated area based on the information received from the suction cleaner.

Meanwhile, when information on the designated area is received from the terminal while driving in the cleaning area according to a pre-input cleaning command, the robot cleaner according to the present invention may continue to drive according to an existing cleaning command, and drive within the designated area when entering the designated area.

In order to achieve the above object, the control system of a robot cleaner according to the present invention may include a robot cleaner that stores a map including information on a drivable area of a cleaning area and drives in the cleaning area; and a terminal that inputs a cleaning command to the robot cleaner.

The terminal may display the map and set a virtual designated area on the map in response to a user input.

The robot cleaner may move to the designated area and drive within the designated area when the designated area is set from the terminal.

The terminal may set the designated area in a form of a surface connecting a plurality of points.

The terminal may display at least one or more driving patterns, set any one of the driving patterns.

The robot cleaner may drive within the designated area according to the driving pattern set in the terminal.

The terminal may display the designated area in a form of a surface, and set a driving pattern expressed as a line inside the designated area.

The robot cleaner may drive within the designated area according to the driving pattern set in the terminal.

The terminal may display a plurality of divided areas on the map, and set the divided areas as a designated area.

The robot cleaner may drive in the divided areas.

The terminal may set a cleaning order in the divided areas.

The robot cleaner may drive in the divided areas according to the cleaning order set in the terminal.

The terminal may display at least one or more driving patterns, and set any one of the driving patterns.

The robot cleaner may drive within the designated area according to the driving pattern set in the terminal.

In order to achieve the above object, the control method of a robot cleaner according to the present invention may include the steps of displaying a map stored in a robot cleaner on a terminal, and setting a designated area in which the robot cleaner drives in response to the map from the terminal; calculating a location of the designated area with respect to a cleaning area; registering the designated area on the map; and driving the robot cleaner within the designated area.

The control method of a robot cleaner according to the present invention may further includes the steps of determining a current location in response to the map when a cleaning command is input from the terminal; and moving to the designated area when the current location is determined.

The control method of a robot cleaner according to the present invention may further include the steps of: setting a driving pattern from the terminal; and driving the robot cleaner within the designated area according to the driving pattern.

In the step of setting a designated area, the designated area may be set in a form of a surface connecting a plurality of points in the terminal.

In the step of setting a designated area, a plurality of divided areas may be displayed on the map, and the designated area may be set among the divided areas.

In the step of setting a driving pattern, the driving pattern in a form of a line may be generated by touching and dragging within the designated area.

In the step of setting a driving pattern, the driving pattern is generated according to a user input through a virtual direction key displayed on a screen of the terminal.

In order to achieve the above object, the control system of a robot cleaner according to the present invention may include a plurality of robot cleaners that stores a map including information on a drivable area of a cleaning area and drives in the cleaning area; and a terminal that inputs a cleaning command to each of the robot cleaners. The terminal may display the map, and set a plurality of virtual designated areas corresponding to the number of the robot cleaners on the map in response to a user input. Each of the robot cleaners may move to the designated area and drive within the designated area when each of the designated areas is set by the terminal, and drives in the designated area driven by other robot cleaner when the driving for the designated area ends.

In order to achieve the above object, the control system of a robot cleaner according to the present invention may include a first robot cleaner that includes a body including a space therein for accommodating a battery, a water container, and a motor, and a pair of rotation plates including a lower side to which a mop facing the floor surface is coupled and rotatably arranged on a bottom surface of the body, stores a map including information on a drivable area of a cleaning area, and drives in the cleaning areas; a second robot cleaner that includes a body having a dust inlet and a pair of wheels and drives in the cleaning areas; a terminal that inputs a cleaning command to the first robot cleaner and the second robot cleaner. The terminal may display the map, and set a plurality of virtual designated areas corresponding to the number of the robot cleaners including the first robot cleaner and the second robot cleaner on the map in response to a user input. Each of the robot cleaners may move to the designated area and drives within the designated area when each of the designated areas is set by the terminal, and drive in the designated area driven by other robot cleaner when the driving for the designated area ends.

Advantageous Effect

As described above, according to the robot cleaner, the control system of the robot cleaner, and the control method of the robot cleaner according to the present invention, a user can designate an arbitrary area and there is an effect of intensively cleaning the designated area.

In addition, there is an effect that a driving can be performed in a pattern set by a user in a designated arbitrary area.

DESCRIPTION OF DRAWINGS

FIG. 1 is a view for explaining a control system of a robot cleaner according to an embodiment of the present invention.

FIG. 2*a* is a perspective view illustrating a first robot cleaner according to an embodiment of the present invention.

FIG. 2*b* is a view illustrating a partially separated configuration of the first robot cleaner shown in FIG. 2*a*.

FIG. 2*c* is a rear view of the first robot cleaner shown in FIG. 2*a*.

FIG. 2*d* is a bottom view of a first robot cleaner according to an embodiment of the present invention.

FIG. 2*e* is an exploded perspective view of a first robot cleaner.

FIG. 2*f* is a cross-sectional view schematically illustrating a first robot cleaner and its configurations according to an embodiment of the present invention.

FIG. 3 is a block diagram of a first robot cleaner according to an embodiment of the present invention.

FIGS. 4*a* and 4*b* are views schematically illustrating a second robot cleaner according to an embodiment of the present invention.

FIG. 5 is a block diagram of a second robot cleaner according to an embodiment of the present invention.

FIG. 6 is a block diagram of a terminal according to an embodiment of the present invention.

FIG. 7 is a flowchart of a method for controlling a robot cleaner according to an embodiment of the present invention.

FIG. 8 is a view for explaining a state in which a map is displayed on a terminal in a control method of a robot cleaner according to an embodiment of the present invention.

FIG. 9 is a view for explaining a process of setting a designated area in a control method of a robot cleaner according to an embodiment of the present invention.

FIG. 10 is a view for explaining a state in which a designated area is set in a control method of a robot cleaner according to an embodiment of the present invention.

FIG. 11 is a view for explaining a process of inputting a driving pattern after setting a designated area in a control method of a robot cleaner according to an embodiment of the present invention.

FIG. 12 is a view for explaining a process in which a user selects a small area in a terminal in a control method of a robot cleaner according to an embodiment of the present invention.

FIG. 13 is a view for explaining a process of inputting a driving pattern in a control method of a robot cleaner according to an embodiment of the present invention.

FIG. 14 is a view for explaining that a robot cleaner starts from a charging station and drives according to a driving pattern within a designated area in a control method of a robot cleaner according to an embodiment of the present invention.

FIG. 15 is a view for explaining that a robot cleaner drives according to a driving pattern within a designated area in a control method of a robot cleaner according to the embodiment of the present invention.

MODE FOR INVENTION

Hereinafter, preferred embodiments of the present invention will be described in detail with reference to the accompanying drawings.

Since the present invention can have various changes and can have various embodiments, specific embodiments are illustrated in the drawings and will be described in detail in the detailed description. This is not intended to limit the present invention to a specific embodiment, it should be construed to include all modifications, equivalents and substitutes included in the spirit and scope of the present invention.

In describing the present invention, terms such as first and second may be used to describe various components, but the components may not be limited by the terms. The above terms are only for the purpose of distinguishing one component from another. For example, without departing from the scope of the present invention, a first component may be referred to as a second component, and similarly, a second component may also be referred to as a first component.

The term "and/or" may include a combination of a plurality of related listed items or any of a plurality of related listed items.

When a component is referred to as being "connected" or "contacted" to another component, it may be directly connected or contacted to the other component, but it may be understood that other components may exist in between. On the other hand, when it is mentioned that a certain element is "directly connected" or "directly contacted" to another element, it may be understood that the other element does not exist in the middle.

The terms used in the present application are only used to describe specific embodiments, and are not intended to limit the present invention. The singular expression may include the plural expression unless the context clearly dictates otherwise.

In the present application, terms such as "comprise" or "have" are intended to designate that a feature, number, step, operation, component, part, or combination thereof described in the specification exists, and it may be understood that the presence or addition of one or more other features, numbers, steps, operations, components, parts, or combinations thereof is not precluded in advance.

Unless defined otherwise, all terms used herein, including technical or scientific terms, may have the same meaning as commonly understood by one of ordinary skill in the art to which this invention belongs. Terms such as those defined in a commonly used dictionary may be interpreted as having a meaning consistent with the meaning in the context of the related art, and unless explicitly defined in the present application, it may not be interpreted in an ideal or excessively formal meaning.

In addition, the following embodiments are provided to more completely explain to those with average knowledge in the art, and the shapes and sizes of elements in the drawings may be exaggerated for clearer explanation.

FIG. 1 illustrates a view for explaining a control system of a robot cleaner according to an embodiment of the present invention, FIG. 2*a* illustrates a perspective view of a first robot cleaner according to an embodiment of the present invention, FIG. 2*b* illustrates a view in which some components are separated from the first robot cleaner shown in FIG. 2*a*, FIG. 2*c* illustrates a rear view of the first robot cleaner shown in FIG. 2*a*, FIG. 2*d* illustrates a bottom view of a first robot cleaner according to an embodiment of the present invention, FIG. 2*e* illustrates an exploded perspective view of a first robot cleaner, and FIG. 2*f* illustrates a schematic cross-sectional view of a first robot cleaner and its configurations according to an embodiment of the present invention.

The control system of the first robot cleaner 1 of the present invention will be described with reference to FIGS. 1 to 2.

The first robot cleaner 1 is placed on a floor and moved along a floor surface B to clean the floor using a mop. Accordingly, in the following description, a vertical direction is determined based on the state in which the first robot cleaner 1 is placed on the floor.

And, based on a first rotation plate 10 and a second rotation plate 20, a side to which a first lower sensor 123, which will be described later, is coupled is set as a front side.

The 'lowest part' of each configuration described in the present invention may be the lowest-positioned part in each configuration when the robot cleaner 1 is placed on the floor for using, or may be a part closest to the floor.

The first robot cleaner 1 may include a body 50, rotation plates 10, 20 and mops 30, 40. In this case, the rotation plates may be composed of a pair having a first rotation plate 10 and a second rotation plate 20, and the mops 30, 40 may include a first mop 30 and a second mop 40.

The body 50 may form the overall outer shape of the first robot cleaner 1 or may be formed in the form of a frame. Each component constituting the robot cleaner 1 may be coupled to the body 50, and some components constituting the first robot cleaner 1 may be accommodated in the body 50. The body 50 can be divided into a lower body 50*a* and an upper body 50*b*, and the components of the first robot cleaner 1 including a battery 135, a water container 141 and motors 56, 57 can be provided in a space in which the lower body 50*a* and the upper body 50*b* are coupled to each other. (Refer to FIG. 2*e*).

The first rotation plate 10 may be rotatably arranged on the bottom surface of the body 50, the first mop 30 may be coupled to the lower side.

The first rotation plate 10 is made to have a predetermined area, and is formed in the form of a flat plate, a flat frame and the like. The first rotation plate 10 is generally laid horizontally, and thus, the width (or diameter) in the horizontal direction is sufficiently larger than the vertical height. The first rotation plate 10 coupled to the body 50 may be parallel to the floor surface B, or may form an inclination with the floor surface B. The first rotation plate 10 may be formed in a circular plate shape, the bottom surface of the first rotation plate 10 may be generally circular, and the first rotation plate 10 may be formed in a rotationally symmetrical shape as a whole.

The second rotation plate 20 may be rotatably arranged on the bottom surface of the body 50, the second mop 40 may be coupled to the lower side.

The second rotation plate 20 is made to have a predetermined area, and is formed in the form of a flat plate, a flat frame and the like. The second rotation plate 20 is generally laid horizontally, and thus, the horizontal width (or diameter) is sufficiently larger than the vertical height. The second rotation plate 20 coupled to the body 50 may be parallel to the floor surface B, or may be inclined with the floor surface B. The second rotation plate 20 may be formed in a circular plate shape, the bottom surface of the second rotation plate 20 may be substantially circular, and the second rotation plate 20 may have a rotationally symmetrical shape as a whole.

In the first robot cleaner 1, the second rotation plate 20 may be the same as the first rotation plate 10, or may be symmetrically formed. If the first rotation plate 10 is located on the left side of the first robot cleaner 1, the second rotation plate 20 may be located on the right side of the robot cleaner 1, and in this case, the first rotation plate 10 and the second rotation plate can be symmetrical to each other.

The first mop 30 may be coupled to the lower side of the first rotation plate 10 to face the floor surface B.

The first mop 30 has a bottom surface facing the floor to have a predetermined area, and the first mop 30 has a flat shape. The first mop 30 is formed in a form in which the width (or diameter) in the horizontal direction is sufficiently larger than the height in the vertical direction. When the first mop 30 is coupled to the body 50, the bottom surface of the first mop 30 may be parallel to the floor surface B, or may be inclined with the floor surface B.

The bottom surface of the first mop 30 may form a substantially circular shape, and the first mop 30 may be formed in a rotationally symmetrical shape as a whole. In addition, the first mop 30 may be detachably attached to the bottom surface of the first rotation plate 10, and may be coupled to the first rotation plate 10 to rotate together with the first rotation plate 10. The second mop 40 may be coupled to the lower side of the second rotation plate 20 to face the floor surface B.

The second mop 40 has a bottom surface facing the floor to have a predetermined area, and the second mop 40 has a flat shape. The second mop 40 is formed in a form in which the width (or diameter) in the horizontal direction is sufficiently larger than the height in the vertical direction. When the second mop 40 is coupled to the body 50, the bottom surface of the second mop 40 may be parallel to the floor surface B, or may be inclined with the floor surface B.

The bottom surface of the second mop 40 may form a substantially circular shape, and the second mop 40 may have a rotationally symmetrical shape as a whole. In addition, the second mop 40 may be detachably attached to the bottom surface of the second rotation plate 20, and coupled to the second rotation plate 20 to rotate together with the second rotation plate 20.

When the first rotation plate 10 and the second rotation plate 20 rotate in opposite directions at the same speed, the first robot cleaner 1 may move in a linear direction, and move forward or backward. For example, when viewed from above, when the first rotation plate 10 rotates counterclockwise and the second rotation plate 20 rotates clockwise, the first robot cleaner 1 may move forward.

When only one of the first rotation plate 10 and the second rotation plate 20 rotates, the first robot cleaner 1 may change direction and turn around.

When the rotation speed of the first rotation plate 10 and the rotation speed of the second rotation plate 20 are different from each other, or when the first rotation plate 10 and the second rotation plate 20 rotate in the same direction, the first robot cleaner 1 can move while changing direction, and move in a curved direction.

The first robot cleaner 1 may further include a first lower sensor 123.

The first lower sensor 123 is formed on the lower side of the body 50, and is configured to detect a relative distance to the floor surface B. The first lower sensor 123 may be formed in various ways within a range capable of detecting the relative distance between the point where the first lower sensor 123 is formed and the floor surface B.

When the relative distance (which may be a distance in a vertical direction from the floor surface, or a distance in an inclined direction from the floor surface) to the floor surface B, detected by the first lower sensor 123 exceeds a predetermined value or a predetermined range, it may be the case in which the floor surface may be suddenly lowered, and accordingly, the first lower sensor 123 may detect a cliff.

The first lower sensor 123 may be formed of a photosensor, and may be configured to include a light emitting unit for irradiating light and a light receiving unit through which the reflected light is incident. The first lower sensor 123 may be an infrared sensor.

The first lower sensor 123 may be referred to as a cliff sensor.

The first robot cleaner 1 may further include a second lower sensor 124 and a third lower sensor 125.

When a virtual line connecting the center of the first rotation plate 10 and the center of the second rotation plate 20 in a horizontal direction (a direction parallel to the floor surface B) is referred to as a connection line L1, the second lower sensor 124 and the third lower sensor 125 may be formed on the lower side of the body 50 on the same side as the first lower sensor 123 with respect to the connection line L1, and configured to sense the relative distance to the floor surface B (Refer to FIG. 1*d*).

The third lower sensor 125 may be formed opposite to the second lower sensor 124 based on the first lower sensor 123.

Each of the second lower sensor 124 and the third lower sensor 125 may be formed in various ways within a range capable of detecting a relative distance to the floor surface B. Each of the second lower sensor 124 and the third lower sensor 125 may be formed in the same manner as the above-described first lower sensor 123, except for a location where they are formed.

The first robot cleaner 1 may further include a first motor 56, a second motor 57, a battery 135, a water container 141, and a water supply tube 142.

The first motor 56 is configured to be coupled to the body 50 to rotate the first rotation plate 10. Specifically, the first motor 56 may be made of an electric motor coupled to the body 50, and one or more gears may be connected to transmit rotational force to the first rotation plate 10.

The second motor 57 is configured to be coupled to the body 50 to rotate the second rotation plate 20. Specifically, the second motor 57 may be made of an electric motor coupled to the body 50, and one or more gears may be connected to transmit rotational force to the second rotation plate 20.

As such, in the first robot cleaner 1, the first rotation plate 10 and the first mop 30 may be rotated by the operation of the first motor 56, and the second rotation plate 20 and the second mop 40 may be rotated by the operation of the second motor 57.

The second motor 57 may form a symmetry (left and right symmetry) with the first motor 56.

The battery 135 is configured to be coupled to the body 50 to supply power to other components constituting the first robot cleaner 1. The battery 135 may supply power to the first motor 56 and the second motor 57.

The battery 135 may be charged by an external power source, and for this purpose, a charging terminal for charging the battery 135 may be provided on one side of the body 50 or the battery 135 itself.

In the first robot cleaner 1, the battery 135 may be coupled to the body 50.

The water container 141 is made in the form of a container having an internal space so that a liquid such as water is stored therein. The water container 141 may be fixedly coupled to the body 50, or detachably coupled to the body 50.

In the first robot cleaner 1, the water supply tube 142 is formed in the form of a tube or pipe, and is connected to the water container 141 so that the liquid inside the water container 141 flows through the inside thereof. The water supply tube 142 is configured such that the opposite end connected to the water container 141 is located on the upper side of the first rotation plate 10 and the second rotation plate 20, and accordingly, the liquid inside the water container 141 can be supplied to the mop 30 and the second mop 40.

In the first robot cleaner 1, the water supply tube 142 may be formed in a form in which one tube is branched into two, in this case, one branched end is located on the upper side of the first rotation plate 10, and the other branded end is located on the upper side of the second rotation plate 20.

The first robot cleaner 1 may include a water pump 143 to move the liquid through the water supply tube 142.

The first robot cleaner 1 may further include a bumper 58, a first sensor 121, and a second sensor 122.

The bumper 58 is coupled along the outline of the body 50, and is configured to move relative to the body 50. For example, the bumper 58 may be coupled to the body 50 so as to reciprocate along a direction approaching the center of the body 50.

The bumper 58 may be coupled along a portion of the outline of the body 50, or may be coupled along the entire outline of the body 50.

The first sensor 121 may be coupled to the body 50 and configured to detect a movement (relative movement) of the bumper 58 with respect to the body 50. The first sensor 121 may be formed using a microswitch, a photo interrupter, a tact switch and the like.

The second sensor 122 may be coupled to the body 50 and configured to detect a relative distance to an obstacle. The second sensor 122 may be a distance sensor.

Meanwhile, the first robot cleaner 1 according to an embodiment of the present invention may further include a displacement sensor 126.

The displacement sensor 126 may be arranged on the bottom surface (rear surface) of the body 50, and measure a distance moving along the floor surface.

As an example, the displacement sensor 126 may use an optical flow sensor (OFS) that acquires image information of the floor surface using light. Here, the optical flow sensor (OFS) is configured to include an image sensor for acquiring image information of the floor surface by photographing an image of the floor surface, and one or more light sources for controlling an amount of light.

The operation of the displacement sensor 126 will be described using the optical flow sensor as an example. The optical flow sensor is provided on the bottom surface (rear surface) of the first robot cleaner 1, and takes pictures a downward side, that is, the floor surface during movement. The optical flow sensor converts a downward image input from the image sensor to generate downward image information in a predetermined format.

With this configuration, the displacement sensor 126 may detect the relative location of a predetermined point and the first robot cleaner 1 irrespective of slippage. That is, it is possible to correct the location due to sliding by using the optical flow sensor to monitor the downward side of the first robot cleaner 1.

Meanwhile, the first robot cleaner 1 according to an embodiment of the present invention may further include an angle sensor 127.

The angle sensor 127 may be arranged inside the body 50 and measure a movement angle of the body 50.

For example, the angle sensor 127 may use a gyro sensor that measures the rotation speed of the body 50. The gyro sensor may detect a direction of the first robot cleaner 1 using a rotation speed.

With this configuration, the angle sensor 127 may detect an angle with the direction in which the first robot cleaner 1 proceeds based on a predetermined virtual line.

Meanwhile, the present invention may further include a virtual connection line L1 connecting the rotation shafts of the pair of rotation plates 10 and 20 to each other. Specifically, the connecting line L1 may mean a virtual line connecting the rotation shaft of the first rotation plate 10 and the rotation shaft of the second rotation plate 20.

The connecting line L1 may serve as a reference for dividing the front and rear of the first robot cleaner 1. As an example, the direction in which the first lower sensor 123 is arranged relative to the connection line L1 may be referred to as the front of the first robot cleaner 1, the direction in which the water container 141 is arranged based on the connection line L1 may be referred to as the rear of the first robot cleaner 1.

Accordingly, the first lower sensor 123, the second lower sensor 124, and the third lower sensor 125 may be arranged on the front lower side of the body 50 based on to the connection line L1, and the first sensor 121 may be arranged inside the front outer circumferential surface of the body 50, and the second sensor 122 may be disposed at the front upper side of the body 50. In addition, the battery 135 may be inserted and coupled to the front of the body 50 in a direction perpendicular to the floor surface B based on the connection line L1. And the displacement sensor 126 may be arranged at the rear of the body based on the connection line L1.

On the other hand, the present invention may further include a virtual driving direction line H perpendicular to the connecting line L1 at the midpoint C of the connecting line L1 and extending parallel to the floor surface B. Specifically, the driving direction line H may include a forward driving direction line Hf extending parallel to the floor surface B toward the direction in which the battery 135 is arranged based on the connecting line L1 and a rear driving direction line Hb extending parallel to the floor surface B toward the direction in which the water tank 141 is arranged based on the connection line L1. Accordingly, the battery 135 and the first lower sensor 123 may be arranged on the forward driving direction line Hf, and the displacement sensor 126 and the water tank 141 may be arranged on the rear driving direction line Hb. In addition, the first rotation plate 10 and the second rotation plate 20 may be arranged symmetrically (line symmetrical) based on the driving direction line H as a center (reference).

With this configuration, the driving direction line H may mean a direction in which the first robot cleaner 1 drives.

Meanwhile, for better understanding, the front end of the first robot cleaner 1 of the present invention will be described as follows. The front end of the first robot cleaner 1 in the present invention may mean a point with the longest distance protruding forward in a horizontal direction based on the connection line L1. For example, the front end of the first robot cleaner 1 may mean a point through which the forward driving direction line Hf passes among the outer peripheral surface of the bumper 58.

In addition, the rear end of the first robot cleaner 1 may refer to a point with the longest distance protruding backward in the horizontal direction based on the connection line L1. For example, the rear end of the first robot cleaner 1 may refer to a point through which the rear driving direction line Hb passes among the outer surfaces of the water tank 141.

Meanwhile, FIG. 3 is a block diagram of the first robot cleaner shown in FIG. 1 of the present invention.

Referring to FIG. 3, the first robot cleaner 1 may include a control unit 110, a sensor unit 120, a power unit 130, a water supply unit 140, a driving unit 150, a communication unit 160, a display unit 170 and a memory 180. The components shown in the block diagram of FIG. 3 are not essential for implementing the first robot cleaner 1, so the first robot cleaner 1 described in the present specification can have more or fewer components than those listed above.

First, the control unit 110 may be arranged inside the body 50, and connected to a control device (not shown) through wireless communication by a communication unit 160 to be described later. In this case, the control unit 110 may transmit various data about the first robot cleaner 1 to the connected control device (not shown). And, it is possible to receive data from the connected control device and store it. Here, the data input from the control device may be a control signal for controlling at least one function of the first robot cleaner 1.

In other words, the first robot cleaner 1 may receive a control signal based on a user input from the control device and operate according to the received control signal.

In addition, the control unit 110 may control the overall operation of the robot cleaner. The control unit 110 controls the first robot cleaner 1 to autonomously drive a surface to be cleaned and perform a cleaning operation according to the set information stored in the memory 180 to be described later.

Meanwhile, in the present invention, the straight-line control of the control unit 110 will be described later.

The sensor unit 120 may include one or more of the first lower sensor 123, the second lower sensor 124, the third lower sensor 125, the first sensor 121 and the second sensor 122 of the first robot cleaner 1 described above.

In other words, the sensor unit 120 may include a plurality of different sensors capable of detecting the environment around the first robot cleaner 1, and the information on the environment around the first robot cleaner 1 detected by the sensor unit 120 may be transmitted to the control device by the control unit 110. Here, the information on the environment may be, for example, whether an obstacle exists, whether a cliff is detected, whether a collision is detected, and the like.

The control unit 110 may be configured to control the operation of the first motor 56 and/or the second motor 57 according to the information of the first sensor 121. For example, when the bumper 58 comes into contact with an obstacle while the first robot cleaner 1 is driving, the location where the bumper 58 comes into contact may be detected by the first sensor 121, and the control unit 110 may control the operation of the first motor 56 and/or the second motor 57 to leave this contact location.

In addition, according to the information of the second sensor 122, when the distance between the first robot cleaner 1 and the obstacle is less than or equal to a predetermined value, the control unit 110 may control the operation of the first motor 56 and/or the second motor 57 such that the driving direction of the first robot cleaner 1 is switched, or the first robot cleaner 1 moves away from the obstacle.

In addition, according to the distance detected by the first lower sensor 123, the second lower sensor 124 or the third lower sensor 125, the control unit 110 may control the operation of the first motor 56 and/or the second motor 57 such that the first robot cleaner 1 stops or changes the driving direction.

In addition, according to the distance detected by the displacement sensor 126, the control unit 110 controls the operations of the first motor 56 and/or the second motor 57 so that the driving direction of the first robot cleaner 1 is changed. For example, when the first robot cleaner 1 slips and deviates from the input driving path or driving pattern, the displacement sensor 126 may measure a distance deviating from the input driving path or driving pattern, and the control unit 110 may control the operations of the first motor 56 and/or the second motor 57 to compensate for this.

In addition, according to the angle detected by the angle sensor 127, the control unit 110 may control the operations of the first motor 56 and/or the second motor 57 so that the driving direction of the first robot cleaner 1 is changed. For example, when the first robot cleaner 1 slips and deviates from the driving direction in which the proceeding direction of the first robot cleaner 1 is input, the angle sensor 127 may measure the angle deviating from the input driving direction, and the control unit 110 may control the operations of the first motor 56 and/or the second motor 57 to compensate for this.

Meanwhile, the power unit 130 receives external power and internal power under the control of the control unit 110 to supply power required for operation of each component. The power unit 130 may include the battery 135 of the first robot cleaner 1 described above.

The water supply unit 140 may include the water container 141, the water supply tube 142, and the water pump 143 of the first robot cleaner 1 described above. The water supply unit 140 can be formed to adjust the water supply amount of the liquid (water) supplied to the first mop 30 and the second mop 40 during the cleaning operation of the first robot cleaner 1 according to the control signal of the control unit 110. The control unit 110 may control a driving time of a motor that drives the water pump 143 to adjust the water supply amount.

The driving unit 150 may include the first motor 56 and the second motor 57 of the first robot cleaner 1 described above. The driving unit 150 may be formed such that the first robot cleaner 1 rotates or moves in a straight line according to a control signal of the control unit 110.

Meanwhile, the communication unit 160 may be arranged inside the body 50, and include at least one module that enables wireless communication between the first robot cleaner 1 and a wireless communication system, or between the first robot cleaner 1 and a preset peripheral device, or between the first robot cleaner 1 and a preset external server.

For example, the at least one module may include at least one of an IR (Infrared) module for infrared communication, an ultrasonic module for ultrasonic communication, or a short-range communication module such as a WiFi module or a Bluetooth module.

Alternatively, it may be formed to transmit/receive data to/from a preset device through various wireless technologies such as wireless LAN (WLAN) and wireless-fidelity (Wi-Fi), including wireless internet module.

Meanwhile, the display unit 170 displays information to be provided to a user. For example, the display unit 170 may include a display for displaying a screen. In this case, the display may be exposed on the upper surface of the body 50.

In addition, the display unit 170 may include a speaker for outputting sound. For example, the speaker may be built into the body 50. In this case, it is preferable that a hole through which a sound can pass is formed in the body 50 corresponding to the location of the speaker. The source of the sound output by the speaker may be sound data prestored in the first robot cleaner 1. For example, the prestored sound data may be about a voice guidance corresponding to each function of the first robot cleaner 1 or a warning sound for notifying an error.

In addition, the display unit 170 may be formed of any one of a light emitting diode (LED), a liquid crystal display (LCD), a plasma display panel, and an organic light emitting diode (OLED).

The memory 180 may be arranged inside the body 50, and include various data for driving and operating the first robot cleaner 1. The memory 180 may include an application program for autonomous driving of the first robot cleaner 1 and various related data. In addition, each data sensed by the sensor unit 120 may be stored, and the information on various settings (values) selected or input by the user (for example, cleaning reservation time, cleaning mode, water supply amount, LED brightness level, volume level of notification sound, etc.) may be included.

Meanwhile, the memory 180 may include information on the surface to be cleaned currently given to the first robot cleaner 1. For example, the information on the surface to be cleaned may be map information mapped by the first robot cleaner 1 by itself. And the map information, that is, the map may include various information set by the user for each area constituting the surface to be cleaned.

In addition, information on the driving pattern may be stored in the memory 180. For example, the driving pattern set by a user input may be stored in the memory 180. In addition, various types of patterns that drive while repeatedly reciprocating in a predetermined area may be stored in the memory 180.

FIG. 4*a* illustrates a perspective view of a second robot cleaner according to an embodiment of the present invention, and FIG. 4*b* illustrates a view of the second robot cleaner according to an embodiment of the present invention, viewed from a different direction.

The second robot cleaner 2 according to an embodiment of the present invention is placed on the floor and configured to clean the floor while moving along the floor surface B. Accordingly, in the following description, a vertical direction is determined based on the state in which the second robot cleaner 2 is placed on the floor.

In addition, based on a first driving wheel 221*a* and a second driving wheel 221*b*, the side to which an agitator 232, which will be described later, is coupled is determined as a front side.

The 'lowest part' of each configuration described in an embodiment of the present invention may be the lowest part or the part closest to the floor in each configuration when the second robot cleaner 2 according to an embodiment of the present invention is placed on the floor.

The second robot cleaner 2 according to an embodiment of the present invention is configured to include a body 210, a driving unit 220, a cleaning unit 230, a sensor unit 240, a battery 250 and a control unit 260.

The body 210 may form the overall appearance of the second robot cleaner 2 or may be formed in the form of a frame. Each part constituting the second robot cleaner 2 may be coupled to the body 210, and some parts constituting the second robot cleaner 2 may be accommodated in the body 210.

Specifically, the body 210 may be divided into a lower body 211 and an upper body 212 covering the lower body 211, and the parts of the second robot cleaner 2 may be provided in a space formed by coupling the lower body 211 and the upper body 212 to each other. For example, the battery 250 and at least one motor may be accommodated in an internal space of the body 210.

When viewed from above or below, the body 210 may have various shapes, such as a circle, an oval, or a square.

The lower body 211 may be coupled to the upper body 212 to form a space accommodating a suction motor 233, a battery 250, at least one sensor, and at least one motor therein.

In addition, a suction port and a pair of wheel holes may be formed in the lower body 211.

The suction port may be a passage through which the dust of the floor surface is introduced. For example, the suction port may be formed in the form of a rectangular hole. With this configuration, when the suction motor 233 is operated, the air containing dust may be introduced through the suction port, and the dust contained in the air may be collected in a dust container (not shown).

An agitator 232 to be described later may be rotatably accommodated in the suction port. With such a configuration, dust around the suction port can be guided into the suction port by the rotation of the agitator 232, and the efficiency of sucking the dust can be increased.

The pair of wheel holes may be formed in the lower body 211, may be formed symmetrically left and right, and may accommodate the driving wheels 221 therein, respectively.

Although not shown, the lower body 211 may further include a side brush. While rotating, the side brush may collect the dust existing on the left and right sides of the driving direction of the second robot cleaner 2 and guide it to the suction port.

In addition, at least one auxiliary wheel 211*a* may be provided on the bottom surface of the lower body 211. For example, the auxiliary wheel 211*c* may be provided with one at the front and one at the rear of the bottom surface of the lower body 211. With this configuration, the auxiliary wheel 211*c* may guide the movement of the second robot cleaner 2 while minimizing friction between the second robot cleaner 2 and the floor surface.

The upper body 212 may form an upper exterior of the second robot cleaner 2. Although not shown, a display may be provided on the upper body 212.

The second robot cleaner 2 of the present invention may include a bumper 213. The bumper 213 is coupled along the outline of the body 210, and is configured to move relative to the body 210. For example, the bumper 213 may be coupled to the body 210 to be reciprocally movable along a direction approaching the center of the body 210.

The bumper 213 may be coupled along a portion of the outline of the body 210, or along the entire outline of the body 210. At least one elastic member (not shown) may be provided between the bumper 213 and the body 210. With this configuration, when the bumper 213 is moved relative to the center of the body 210 in contact with an obstacle, etc., the bumper 213 can return to its original location by the restoring force of the elastic member (not shown), and the bumper can prevent and reduce the transmission of the shock to the body 210 by absorbing or distributing the shock applied to the bumper 213.

The driving unit 220 may be provided on the body 210 and drive on the floor surface.

The driving unit 220 may include a driving wheel 221 and an actuator 222. In this case, the driving wheel 221 may be accommodated in the wheel hole formed in the lower body 211, and coupled to the actuator 222. In this case, the actuator 222 may be coupled to the body 210.

The driving wheel 221 may be provided on the body 210 and roll on the floor surface.

The driving wheel 221 may be constituted with a first driving wheel 221*a* and a second driving wheel 221*b*. In this case, the first driving wheel 221*a* and the second driving wheel 221*b* may be formed identically to each other or symmetrically to each other. For example, if the first driving wheel 221*a* is located on the left side of the second robot cleaner 2, the second driving wheel 221*b* may be located on the right side of the second robot cleaner 2, and in this case, the first driving wheel 221*a* and the second driving wheel 221*b* may be symmetrical left and right to each other.

The actuator 222 may be constituted to include a first driving motor 222*a*, a second driving motor 222*b*, and a gear. In this case, the first driving motor 222*a* and the second driving motor 222*b* may be accommodated inside the body 210 and provide power to the first driving wheel 221*a* and the second driving wheel 221*b*, respectively.

In this case, the first driving motor 222*a* and the second driving motor 222*b* may be formed of electric motors. At least one gear may be provided and rotated by engaging with each other. The gear connects the driving motors 222*a* and 222*b* and the driving wheels 221*a* and 221*b*, and transmits the rotational power of the driving motors 222*a* and 222*b* to the driving wheels 221*a* and 221*b*.

With this configuration, when the first driving motor 222*a* and the second driving motor 222*b* are operated, the first driving wheel 221*a* and the second driving wheel 221*b* may rotate, and the body 210 may drive on the floor surface at a predetermined driving speed.

The cleaning unit 230 may collect dust by inhaling dust and air on the floor surface.

The cleaning unit 230 may include a suction nozzle 231, an agitator 232, a suction motor 233, and a dust container (not shown).

The suction nozzle 231 may guide dust and air flowing into the suction port to a dust container (not shown). For example, the suction nozzle 231 may be formed in a tube shape to connect the suction port and the dust container (not shown). That is, the suction nozzle 231 may communicate the suction port and the inner space of the dust container (not shown).

The agitator 232 is provided with a plurality of rotatable brushes to guide external dust and air to the dust container. In this case, the agitator 232 may be provided with at least one gear.

On the other hand, in the agitator 232 according to the present embodiment, a separate agitator motor may be installed to provide rotational power, and according to the embodiment, it is also possible to receive rotational power from the driving motors 222*a* and 222*b* or the suction motor 233.

A dust container (not shown) may store dust introduced through the suction nozzle 231. The dust container may have a dust inlet communicating with the suction nozzle 231, a space for storing dust, and an air outlet through which air can be discharged.

The suction motor 233 may generate a suction force capable of sucking external dust and air. For example, the suction motor 233 may be an electric motor.

Meanwhile, although not shown, at least one filter may be provided in the dust container of the present embodiment. The fine dust contained in the air can be separated by the filter, and it is possible to prevent the fine dust from being discharged into the air again.

Meanwhile, FIG. 5 is a diagram for explaining control of a robot cleaner according to an embodiment of the present invention.

Referring to FIG. 5, the sensor unit 240 may detect an obstacle in the cleaning area of the second robot cleaner 2.

The sensor unit 240 may include a first sensor 241, a second sensor 242, and a third sensor 243.

The first sensor 241 may be coupled to the body 210 and configured to detect a movement (relative movement) of the bumper 213 with respect to the body 210. The first sensor 410 may be formed using a microswitch, a photo interrupter, a tact switch, and the like.

The second sensor 242 may be coupled to the body 210 and configured to detect a relative distance to an obstacle. The second sensor 242 may be a distance sensor.

The third sensor 243 may be coupled to the body 210 and configured to detect a relative distance from the floor surface.

When the relative distance to the floor surface (which may be a vertical distance from the floor surface or an inclined distance from the floor surface) detected by the third sensor 243 exceeds a predetermined value, or a predetermined range, it may be a case in which the bottom surface is suddenly lowered, accordingly, the third sensor 243 may detect a cliff.

The third sensor 243 may be formed of a photosensor, and configured to include a light emitting unit for irradiating light and a light receiving unit for receiving reflected light. The third sensor 243 may be an infrared sensor.

The third sensor 243 may be referred to as a cliff sensor.

Meanwhile, the second robot cleaner 2 according to an embodiment of the present invention may further include a displacement sensor 244.

The displacement sensor 244 may be arranged on the bottom surface (rear surface) of the body 210, and measure a distance moving along the floor surface.

As an example, the displacement sensor 244 may use an optical flow sensor (OFS) that acquires image information of the floor surface using light. Here, the optical flow sensor (OFS) is configured to include an image sensor for acquiring image information of the floor surface by photographing an image of the floor surface, and one or more light sources for controlling an amount of light.

With this configuration, the displacement sensor can detect the relative location of a predetermined point and the second robot cleaner 2 irrespective of slippage. That is, by monitoring the downward side of the second robot cleaner 2 using the optical flow sensor, it is possible to correct the location by sliding.

Meanwhile, the second robot cleaner 2 according to an embodiment of the present invention may further include an angle sensor 245.

The angle sensor 245 may be arranged inside the body 210 and measure the movement angle of the body 210.

For example, the angle sensor may use a gyro sensor that measures the rotation speed of the body 100. The gyro sensor may detect the direction of the second robot cleaner 2 using the rotation speed.

With this configuration, the angle sensor can detect an angle with the direction in which the second robot cleaner 2 proceeds.

In the second robot cleaner 2 according to an embodiment of the present invention, the battery 250 may be accommodated in the inner space formed by combining the lower body 211 and the upper body 212.

The battery 250 may be coupled to the body 210 to supply power to other components constituting the second robot cleaner 2. The battery 250 may supply power to the first driving motor 222*a* and the second driving motor 222*b*.

Also, the battery 250 may supply power to the suction motor 233, the sensor unit 240, and the control unit 260.

In an embodiment of the present invention, the battery 250 may be charged by an external power source, and for this, one side of the body 210 or the battery 250 itself is provided with a charging terminal for charging the battery 250.

The control unit 260 may be configured to control the operations of the first driving motor 222*a* and the second driving motor 222*b* according to preset information or real-time information. For the control of the control unit 260, the second robot cleaner 2 may include a storage medium in which an application program is stored, and the control unit 260 may be configured to control the second robot cleaner 2 by driving an application program according to information input to the second robot cleaner 2, information output from the cleaner 2 and the like.

The control unit 260 may control the driving direction of the second robot cleaner 2. That is, the control unit 260 may control the rotation direction and rotation speed of the first driving motor 222*a* and the second driving motor 222*b* to control the rotation direction and rotation speed of the driving wheel 221.

In this case, the control unit 260 may control the second robot cleaner 2 to drive in a straight line or in a straight line reciprocating, and may control the second robot cleaner 2 to drive according to a preset driving pattern.

The control unit 260 may control the second robot cleaner 2 to perform avoidance operation when the bumper 213 of the second robot cleaner 2 comes into contact with an obstacle, and may control the operations of the first driving motor 222*a* and the second driving motor 222*b* according to the information by the first sensor 241.

When the distance between the second robot cleaner 2 and the obstacle is less than or equal to a predetermined value according to the information by the second sensor 242, the control unit 260 may control the operations of the first driving motor 222*a* and the second driving motor 222*b* such that the driving direction of the second robot cleaner 2 is changed, or the second robot cleaner 2 moves away from the obstacle.

In addition, the control unit 260 may control the operations of the first driving motor 222*a* and the second driving motor 222*b* according to the distance detected by the third sensor 243, so that the second robot cleaner 2 is stopped or the driving direction is changed.

The control unit 260 may control the cleaning unit 230. Specifically, the control unit 260 may control the output of the suction motor 233. That is, the control unit 260 may control the rotation speed of the suction motor 233. Also, the control unit 260 may control the rotation speed of the agitator 232.

Also, the control unit 260 may control the output of the suction motor 233 according to the amount of dust on the floor surface.

The communication unit 270 may be arranged inside the body 210, and include at least one module that enables wireless communication between the second robot cleaner 2 and the wireless communication system, or between the second robot cleaner 2 and a preset peripheral device, or between the second robot cleaner 2 and a preset external server.

For example, the at least one module may include at least one of an IR (Infrared) module for infrared communication, an ultrasonic module for ultrasonic communication, or a short-range communication module such as a WiFi module or a Bluetooth module. Alternatively, it may be formed to transmit/receive data to/from a preset device through various wireless technologies such as wireless LAN (WLAN) and wireless-fidelity (Wi-Fi), including wireless internet module.

Meanwhile, the display unit 280 displays information to be provided to a user. For example, the display unit 280 may include a display for displaying a screen. In this case, the display may be exposed on the upper surface of the body 210.

In addition, the display unit 280 may include a speaker for outputting sound. For example, the speaker may be built into the body 210.

In addition, the display unit 280 may be formed of any one of a light emitting diode (LED), a liquid crystal display (LCD), a plasma display panel, and an organic light emitting diode (OLED).

The memory 290 may be arranged inside the body 210, and include various data for driving and operating the second robot cleaner 2. The memory 290 may include an application program for autonomous driving of the second robot cleaner 2 and various related data. In addition, each data sensed by each sensor may be stored, and the information on various settings (values) selected or input by the user (for example, cleaning reservation time, cleaning mode, water supply amount, LED brightness level, volume level of notification sound, etc.) may be included.

Meanwhile, the memory 290 may include information on the surface to be cleaned currently given to the second robot cleaner 2. For example, the information on the surface to be cleaned may be map information mapped by the second robot cleaner 2 by itself. Alternatively, the information on the surface to be cleaned may be map information mapped by the first robot cleaner 1. And the map information, that is, the map may include various information set by the user for each area constituting the surface to be cleaned.

In addition, information on the driving pattern may be stored in the memory 290. For example, the driving pattern set by a user input may be stored in the memory 290. In addition, various types of patterns that drive while repeatedly reciprocating in a predetermined area may be stored in the memory 290.

FIG. 6 is an internal block diagram of a terminal 5 according to an embodiment of the present invention.

The terminal 5 may be communicatively connected to the robot cleaners 1, 2 including the first robot cleaner 1 and the second robot cleaner (hereinafter, it can be referred as the robot cleaners 1, 2 in the case in which the robot cleaners 1 and 2 are not distinguished), receive data from the robot cleaners 1 and 2, and transmit a cleaning command and data to the robot cleaners 1 and 2.

Referring to FIG. 6, the terminal 5 according to an embodiment of the present invention may include a server, a wireless communication unit 510 for exchanging data with other electronic devices such as the robot cleaner 1, 2, and a control unit 580 that controls the screen of the application to be displayed on the display unit 551 according to a user input executing the application for controlling the robot cleaner 1, 2.

In addition, the terminal 5 may further include an A/V (Audio/Video) input unit 520, a user input unit 530, a sensing unit 540, an output unit 550, a memory 560, an interface unit 570 and a power supply unit 590.

The application for controlling the robot cleaner 1, 2 may include a main screen that can receive a user input related to the control signal for controlling the robot cleaner 1, 2.

Meanwhile, the wireless communication unit 510 may receive location information and status information directly from the robot cleaner 1, 2 or may receive location information and status information of the robot cleaner 1, 2 through a server.

Meanwhile, the wireless communication unit 510 may include a broadcast reception module 511, a mobile communication module 513, a wireless internet module 515, a short-range communication module 517, a GPS module 519 and the like.

The broadcast reception module 511 may receive at least one of a broadcast signal and broadcast related information from an external broadcast management server through a broadcast channel. In this case, the broadcast channel may include a satellite channel, a terrestrial channel, and the like.

The broadcast signal and/or broadcast related information received through the broadcast reception module 511 may be stored in the memory 560.

The mobile communication module 513 transmits/receives wireless signals to and from at least one of a base station, an external terminal, and a server on a mobile communication network. Here, the wireless signal may include various type of data according to transmission/reception of a voice call signal, a video call call signal, or text/multimedia message.

The wireless internet module 515 refers to a module for wireless internet access, and the wireless internet module 515 may be built-in or external to the terminal 5 for controlling the robot cleaner 1, 2. For example, the wireless internet module 515 may perform WiFi-based wireless communication or WiFi Direct-based wireless communication.

The short-range communication module 517 is for short-range communication, and may support short-range communication using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (Wireless USB) technologies.

The short-distance communication module 517 may support wireless communication between the terminal 5 for controlling the robot cleaner 1, 2 through a short-range wireless communication network (Wireless Area Networks) and a wireless communication system, between the terminal 5 and the control device of another robot cleaner, or between the terminal 5 and another mobile terminal, or between networks in which an external server is located. The short-range wireless communication network may be Wireless Personal Area Networks.

The Global Position System (GPS) module 519 may receive location information from a plurality of GPS satellites.

Meanwhile, the wireless communication unit 510 may exchange data with a server using one or more communication modules.

The wireless communication unit 510 may include an antenna 505 for wireless communication, and may include an antenna for receiving a broadcast signal in addition to an antenna for a call and the like.

The A/V (Audio/Video) input unit 520 is for inputting an audio signal or a video signal, and may include a camera 521, a microphone 523, and the like.

The user input unit 530 generates key input data input by a user to control the operation of the terminal 5. To this end, the user input unit 530 may include a key pad, a dome switch, a touch pad (static pressure/capacitive), and the like. In particular, when the touch pad forms a mutual layer structure with the display unit 551, it may be referred to as a touch screen.

The sensing unit 540 may generate a sensing signal for controlling the operation of the terminal 5 by detecting the current status of the terminal 5 such as the opening/closing status of the terminal 5, the location of the terminal 5, the presence or absence of user contact, and the like.

The sensing unit 540 may include a proximity sensor 541, a pressure sensor 543, a motion sensor 545, and the like. The motion sensor 545 may detect a motion or location of the terminal 5 using an acceleration sensor, a gyro sensor, a gravity sensor, and the like. In particular, the gyro sensor is a sensor for measuring angular velocity, and may detect a direction (angle) that is turned with respect to a reference direction.

The output unit 550 may include a display unit 551, a sound output module 553, a notification unit 555, a haptic module 557 and the like.

On the other hand, when the display unit 551 and the touch pad form a mutual layer structure and are configured as a touch screen, the display unit 551 may be used as an input device capable of inputting information by a user's touch in addition to an output device.

In this case, a screen for receiving an input from a user for a set value related to the control signal for controlling the robot cleaner 1, 2 may be displayed on the display unit 551, and the information processed by the terminal 5, such as another screen that is switched from the screen according to the user input and displayed, may be displayed and output.

That is, the display unit 551 may serve to receive information by a user's touch input, and at the same time, may also serve to display the information processed by the control unit 580, which will be described later.

The sound output module 553 outputs audio data received from the wireless communication unit 510 or stored in the memory 560. The sound output module 553 may include a speaker, a buzzer, and the like.

The notification unit 555 may output a signal for notifying the occurrence of an event in the terminal 5. For example, the signal may be output in a form of vibration.

The haptic module 557 generates various tactile effects that a user can feel. A representative example of the tactile effect generated by the haptic module 557 is a vibration effect.

The memory 560 may store a program for processing and control of the control unit 580, and perform a function for temporary storage of input or output data (for example, phonebook, message, still image, video, etc.).

The interface unit 570 functions as an interface with all external devices connected to the terminal 5. The interface unit 570 may receive data or power from such an external device and transmit it to each component inside the terminal 5, and allow the data inside the terminal 5 to be transmitted to an external device (for example, it may be transmitted to the robot cleaner 1, 2).

The control unit 580 controls the overall operation of the terminal 5 by generally controlling the operations of the respective units. For example, it may perform related control and processing for voice calls, data communications, video calls, and the like. In addition, the control unit 580 may include a multimedia playback module 581 for playing multimedia. The multimedia playback module 581 may be configured as a hardware in the control unit 580 or may be configured as a software separately from the control unit 580.

In addition, the control unit 580 may display a control screen for controlling the robot cleaner 1, 2 on the display unit 551, control the switching of the control screen according to a user's touch input, and transmit to the robot cleaner 1, 2 the control signal for controlling the robot cleaner 1, 2 based on the user input inputted through the display unit 551.

The power supply unit 590 receives external power and internal power under the control of the control unit 580 to supply the power required for operation of each component.

Meanwhile, the block diagram of the terminal 5 shown in FIG. 4 is a block diagram for an embodiment of the present invention. Each component in the block diagram may be integrated, added, or omitted according to the specifications of the actually implemented control device.

That is, two or more components may be combined into one component, or one component may be subdivided into two or more components as needed. In addition, the function performed by each block is for explaining the embodiment of the present invention, and the specific operation or device does not limit the scope of the present invention.

FIG. 7 illustrates a flowchart of a method for controlling a robot cleaner according to an embodiment of the present invention, FIG. 8 illustrates a view for explaining a state in which a map is displayed on a terminal in a control method of a robot cleaner according to an embodiment of the present invention, FIGS. 9 and 10 illustrate views for explaining a process of setting a designated area in a control method of a robot cleaner according to an embodiment of the present invention, FIG. 11 illustrates a view for explaining a process of inputting a driving pattern after setting a designated area in a control method of a robot cleaner according to an embodiment of the present invention, FIG. 12 illustrates a view for explaining another process of setting a designated area in a control method of a robot cleaner according to an embodiment of the present invention, FIG. 13 illustrates a view for explaining a process of inputting a driving pattern in a control method of a robot cleaner according to an embodiment of the present invention, and FIGS. 14 and 15 illustrate views for explaining that a robot cleaner drives according to a driving pattern within a designated area in a control method of a robot cleaner according to an embodiment of the present invention.

A control method of a robot cleaner according to an embodiment of the present invention will be described with reference to FIGS. 7 to 15.

According to the premise of the present invention, the robot cleaners 1 and 2 may include information on the surface to be cleaned. That is, a map for a cleaning area may be stored in the memories 180 and 290 of the robot cleaners 1 and 2. For example, the information on the surface to be cleaned may be map information mapped by the first robot cleaner 1 or the second robot cleaner 2 by itself.

On the other hand, if a map for the cleaning area is not stored in the robot cleaners 1, 2, or it is an initial operation, the map can be generated by driving in the cleaning area through wall following, etc. In addition, the robot cleaners 1 and 2 may generate a map based on obstacle information obtained while performing cleaning on the cleaning area in the absence of a map.

Meanwhile, various well-known methods may be applied to the map generation method of the robot cleaners 1 and 2, and detailed description thereof will be omitted.

On the other hand, the terminal 5 may receive information on driving in the cleaning area from the robot cleaners 1 and 2. For example, the robot cleaners 1 and 2 may generate location information of obstacles while driving in the cleaning area. In addition, the robot cleaners 1 and 2 may detect the degree of contamination of the cleaning area while driving in the cleaning area, and generate location information on a location with a high degree of contamination. In addition, the terminal 5 may receive location information of an obstacle and/or location information of a location having a high degree of contamination from the robot cleaners 1 and 2.

The control method of the robot cleaners 1 and 2 according to the present invention may include a step of displaying the map stored in the robot cleaners 1 and 2 on the terminal 5, and a step (S10) of setting a designated area AD in which the robot cleaners 1 and 2 drive in response to the map from the terminal 5.

Specifically, the map generated by the robot cleaners 1 and 2 may be stored in the memories 180 and 290, and transmitted to an external device such as a remote control, the terminal 5, or other controllers through the communication units 160 and 270.

The terminal 5 may execute a program or an application for controlling the robot cleaners 1 and 2 and display the map received and stored from the robot cleaners 1 and 2 on a screen.

When a cleaning command is input with respect to the displayed map, the terminal 5 may transmit the input cleaning command to the robot cleaners 1 and 2.

In the case in which there is a plurality of robot cleaners 1 and 2, the terminal 5 may transmit each cleaning command in response to each of the robot cleaners 1 and 2. A plurality of divided areas A1 to A7 as shown in FIG. 6 may be displayed differently on the map, and different colors or names of areas may be displayed according to properties of the areas. Also, the properties of the area may be displayed, and the area of the same property may be displayed in the same color. In addition, information on specific obstacles may be displayed on the map in the form of images, icons, emoticons, special characters, and the like.

In addition, the location of the charging station O of the robot cleaners 1 and 2 may be displayed on the map.

The map is subdivided into areas, other areas may be additionally set, and the areas may be modified by the terminal 5.

The robot cleaners 1 and 2 and the terminal 5 store the same map, and when the map is changed on one cleaner, the map can be updated by transmitting the changed data to the other cleaner.

In the step (S10) of setting the designated area AD, a virtual designated area AD may be set on the map in response to a user input.

In respond to a user input, for example, a touch input, the terminal sets the designated area AD according to the number of touch points, the number of touches, a dragged direction and a dragged form with respect to touch, touching and dragging, and multi-touch on a specific point.

Specifically, the terminal 5 may set the designated area AD in the form of a surface connecting a plurality of points in response to a user input.

The terminal 5 sets a virtual wall in response to a user input as follows.

As an example, the terminal 5 may set a designated area AD of a polygon connecting the first point P1 to the fourth point P4 (Refer to FIG. 9).

In this case, the designated area AD may be set in the form of a surface, and the surface may be set in a polygonal, circular, or free form (for example, heart, star).

Meanwhile, the designated area AD may be set inside any one of a plurality of the divided areas A1 to A7, and the designated area AD may be set over two or more areas among the plurality of areas A1 to A7. As an example, the designated area AD may be set in the living room A6, or part of the designated area AD may be set in the living room A6, and the rest of the designated area AD may be set in the room A4 (Refer to FIG. 10).

As another embodiment, in the step (S10) of setting the designated area AD, the designated area AD may be set among a plurality of divided areas A1 to A7 in the terminal 5 (Refer to FIG. 10).

The terminal 5 may set at least one of the plurality of divided areas A1 to A7 as the designated area AD in response to the user input. In this case, the area set as the designated area AD among the plurality of divided areas A1 to A7 may be displayed differently from the unset area, and may be displayed in a different color or the name of the area may be displayed.

On the other hand, when there are two or more user inputs, the terminal 5 may set two or more of the plurality of divided areas A1 to A7 as the designated area AD in response to a touch, touching and dragging, a multi-touch for two or more areas among the plurality of divided areas A1 to A7.

In this case, the terminal 5 may set a cleaning order for the plurality of divided areas A1 to A7.

When there is an order in the user input, the terminal 5 may set, for example, two or more areas among the plurality of divided areas A1 to A7 in order. In this case, in the area set as the designated area AD among the plurality of divided areas A1 to A7, the order of the designated area AD may be displayed according to the set order.

As another embodiment, in the step (S10) of setting the designated area AD, the designated area AD may be set based on information received from the robot cleaners 1 and 2.

Specifically, the terminal 5 may set the designated area AD based on the information generated while the robot cleaners 1 and 2 drive in the cleaning area.

For example, the second robot cleaner 2 may detect the degree of contamination of the cleaning area through the state of the floor surface and the like while driving in the cleaning area. In addition, the second robot cleaner 2 may detect an area in which the degree of contamination exceeds a predetermined reference value and requires additional cleaning or requires wet cleaning (a wet mop cleaning). Also, the second robot cleaner 2 may generate location information for this area. In addition, the terminal 5 may receive location information on a location requiring additional cleaning or wet cleaning from the second robot cleaner 2.

The terminal 5 may set the designated area AD based on the location information received from the second robot cleaner 2 as follows.

The terminal 5 may set the circular designated area AD having a predetermined radius based on a distribution of locations requiring additional cleaning or wet cleaning.

As another example, the terminal 5 may set the designated area AD including a plurality of points having a high degree of contamination therein. In this case, the designated area AD may be set in the form of a surface, and the surface may be set in a polygonal, circular, or free form (for example, heart, star).

Meanwhile, the terminal 5 may set a plurality of designated areas AD when there is a plurality of divided areas requiring additional cleaning or wet cleaning.

On the other hand, in the case in which there is a plurality of robot cleaners 1 and 2 communicating with the terminal 5, the terminal 5 may set a plurality of virtual designated areas corresponding to the number of robot cleaners 1 and 2 on the map in response to a user input. For example, when the terminal 5 can communicate with the first robot cleaner 1 and the second robot cleaner 2, the terminal can set two designated areas AD1 and AD2 on the map in response to a user input.

In addition, the terminal 5 may designate the designated area AD in which the robot cleaners 1 and 2 drive to each of the corresponding robot cleaners 1 and 2 in response to a user input. For example, the terminal 5 may designate a first designated area AD1 to the first robot cleaner 1 and a second designated area AD2 to the second robot cleaner 2.

When the designated area AD is set on the map, the terminal 5 may transmit the data for the designated area AD to the robot cleaners 1 and 2.

In the case in which there is a plurality of robot cleaners 1 and 2 communicating with the terminal 5, the terminal 5 may transmit data for each different designated area AD to each of the robot cleaners 1 and 2. In one embodiment, the terminal 5 may transmit data for each designated area AD designated according to a user input to the corresponding robot cleaners 1 and 2. For example, the data for the first designated area AD1 may be transmitted to the first robot cleaner 1, and the data for the second designated area AD2 may be transmitted to the second robot cleaner 2. In another embodiment, the terminal 5 may transmit the data for the designated area having a high degree of contamination and requiring additional dust suction to the second robot cleaner 2, and transmit the data for the designated area requiring wet cleaning to the first robot cleaner 1.

On the other hand, in the case in which there is a plurality of robot cleaners 1 and 2 communicating with the terminal 5 and there is one designated area AD, the terminal 5 may transmit the data for the designated area AD to each of the robot cleaners 1, 2, also the terminal 5 may transmit the data at a predetermined time interval by setting an order to each of the robot cleaners 1 and 2. For example, the terminal 5 may transmit the data for the designated area AD to the second robot cleaner 2 first, and after a predetermined time elapses, the terminal 5 may transmit the data for the designated area AD to the first robot cleaner 1. With such a configuration, it is possible to implement various cleaning methods, such as a wet mop cleaning after suction cleaning of foreign substances.

Meanwhile, in the present invention, the terminal 5 may store the data for the designated area AD transmitted to the robot cleaners 1 and 2 in the memory 560. In the case in which the designated area AD is transmitted to the plurality of robot cleaners 1 and 2, the terminal 5 may store the data for the robot cleaners 1, 2 that have received the designated area AD together with the designated area AD data in the memory 560.

Thereafter, the terminal 5 may transmit the data for the stored designated area AD to the robot cleaners 1 and 2 according to a user input.

In the case in which there is a plurality of robot cleaners 1 and 2 communicating with the terminal 5, the terminal 5 may select the robot cleaners 1 and 2 according to a user input and transmit the data for the designated area AD to the selected robot cleaners 1 and 2. For example, when mop cleaning (wet cleaning) is required in the designated area AD, the terminal 5 may transmit the data for the designated area AD to the first robot cleaner 1. And, when it is necessary to suck foreign substances in the designated area AD, the terminal 5 may transmit the data for the designated area AD to the second robot cleaner 2.

On the other hand, in the case in which there is a plurality of robot cleaners 1 and 2 communicating with the terminal 5 and there is a designated area AD in which each robot cleaner 1 and 2 has driven before, the terminal 5 may transmit the data for the designated area AD that has been driven in the past to each of the robot cleaners 1 and 2. For example, the terminal 5 may transmit the data for the designated area AD in which the robot cleaners 1 and 2 have previously driven to the corresponding robot cleaners 1 and 2. As another example, the terminal 5 may transmit the data for the designated area AD in which the robot cleaners 1 and 2 have previously driven to the other robot cleaners 1 and 2 than the corresponding robot cleaners 1 and 2.

With such a configuration, a user can simply set the designated area AD by loading a cleaning area in which contamination frequently occurs and select and clean the robot cleaners 1 and 2 according to a required cleaning method.

On the other hand, the control method of the robot cleaner according to the embodiment of the present invention may further include the step (S20) of receiving a driving pattern input from the terminal 5.

The terminal 5 may display at least one driving pattern and set any one of the driving patterns.

Specifically, in the robot cleaners 1 and 2, at least one driving pattern may be stored in the memories 180 and 290, and transmitted to an external device such as a remote control, the terminal 5, and other controllers through the communication units 160 and 270.

The terminal 5 may include a plurality of pattern selection units D1 to D4 for executing a program or application for controlling the robot cleaners 1 and 2 and displaying a plurality of driving patterns on a screen. That is, the plurality of pattern selection units D1 to D4 may be arranged on the display unit 551 (Refer to FIG. 8).

For example, the pattern selection units D2 to D4 may display the driving pattern received and stored from the robot cleaners 1 and 2 on the screen, and display the driving pattern that a user can input on the screen. That is, the user-designated pattern selection unit D1 through which the user can input a pattern and the pre-stored first to third pattern selection units D2 to D4 can be displayed on the display unit 551 in parallel to be selectable.

The pattern selection units D1 to D4 may display a plurality of divided areas as shown in FIG. 6, and schematically display the shape of the driving pattern according to the stored driving pattern. For example, the driving pattern may include four divided areas in the form of a rectangle, and a user-designable mark or a shape such as a spiral shape, a zigzag shape, a connected grid shape and the like can be schematically displayed inside the rectangular area.

In the step (S20) of receiving the driving pattern input, the driving pattern may be set in response to the user input.

The terminal 5 may set a driving pattern in response to a user input, for example, a touch input for each area of the pattern selection units D1 to D4. For example, when a touch input is applied to the pattern selection unit D4 in which a spiral shape is displayed, the terminal 5 may set a driving pattern that rotates spirally. In addition, when a touch input is applied to the selection unit D4 in which the user-designated pattern is displayed, the terminal 5 may set a pattern stored in advance by the user as a driving pattern, or may receive a new driving pattern input from the user.

The input of the driving pattern according to the user designation will be described later.

Meanwhile, in the case in which a plurality of areas is set as the designated area in the step (S10) of setting the designated area AD, the terminal 5 may set a driving pattern for each designated area. This may vary depending on the usage environment, obstacle environment, and floor environment for each designated area.

For example, the map of the robot cleaner may include the data for the location of the obstacle in the cleaning area, the data for the material of the floor surface, and the like. In addition, the robot cleaners 1 and 2 may determine a driving pattern suitable for driving by referring to the usage environment and the obstacle location within the designated area AD and the material of the floor surface, and the like. In addition, the robot cleaners 1 and 2 may transmit the determination result to the terminal 5 and display it on the screen of the terminal 5.

Meanwhile, when each driving pattern is set in the designated area AD, the shape of the driving pattern may be additionally displayed in the set designated area AD on the map of the terminal 5.

In the step (S20) of receiving the driving pattern of the present invention, the terminal 5 may receive the driving pattern input from the user. In addition, in the step (S20) of receiving the driving pattern, the driving pattern in the designated area AD may be generated in response to a user input.

Specifically, the terminal 5 may generate the driving pattern in the form of a line connecting a plurality of points in response to a user input.

The terminal 5 may generate the driving pattern in response to a user input, for example, a touch input.

For example, the terminal 5 may generate the driving pattern according to a user input by displaying a virtual direction key on the screen. That is, in the case in which the areas of forward (W1), backward (W2), left (W3), and right (W4) are displayed separately on the screen as shown in FIG. 11, the terminal 5 may generate the driving pattern according to the number of touches in response to a touch and a multi-touch on a specific area.

Meanwhile, the terminal 5 may display a virtual edit start key or a vertical edit end key on the screen to edit and store the driving pattern according to a user input. That is, the terminal 5 may further display the divided areas of a driving edit (E) or a driving start (S) on the screen, and newly input the driving pattern or edit a part of the stored driving pattern, respectively, in response to the user's touch input, and thus, perform the setting for driving the robot cleaners 1 and 2 according to the input driving pattern.

As another example, in the case in which there is the designated area AD set on the map as shown in FIG. 9, the terminal 5 may generate a driving pattern MP according to a dragged direction and a dragged shape in response to a dragging method in which touching and dragging are performed in the designated area AD on the map.

In this case, the driving pattern MP may be generated in the form of a line, and the line may be set in a free form.

When the driving pattern is set, the terminal 5 may transmit the data for the set driving pattern to the robot cleaners 1 and 2.

Meanwhile, the terminal 5 may store the driving pattern generated by the user in the memory 560 of the terminal 5 or the memories 180 and 290 of the robot cleaners 1 and 2. After the driving pattern generated by the user is stored in the memory 560 of the terminal 5 or the memories 180 and 290 of the robot cleaners 1 and 2, the robot cleaner 1 can be driven according to the stored driving pattern.

Meanwhile, in the present embodiment, the step (S20) of receiving the driving pattern is performed after the step (S10) of setting the designated area AD, but is not limited thereto. According to an embodiment, the step of receiving the driving pattern may be performed independently from the step S10 of setting the designated area AD.

The control method of the robot cleaners 1 and 2 according to the present invention may calculate the location of the designated area AD with respect to the cleaning area (S30) and register the designated area AD on the map (S40).

The robot cleaners 1 and 2 match the data for the designated area AD received from the terminal 5 to the map, determine the location of the designated area AD, and set the corresponding location as a target location for driving. That is, the robot cleaners 1 and 2 calculate the location of the designated area AD as coordinates, determine the location on the map and the location in an actual cleaning area, and set the designated area (target location for driving) of the robot cleaners 1 and 2 based on the designated area AD received from the terminal 5.

Meanwhile, the robot cleaners 1 and 2 may set the designated area in a wider range than the data for the received designated area AD. This is to secure cleaning of the boundary portion of the designated area AD.

The control method of the robot cleaners 1 and 2 according to the present invention may calculate the location of the driving pattern with respect to the designated area AD (S50), and set a driving path of the robot cleaner within the designated area AD (S60).

The robot cleaners 1 and 2 may match the data for driving pattern received from the terminal 5 in consideration of the area of the designated area AD (S50). As an example, the robot cleaner 1 may generate a virtual rectangular plane with a minimum size including a linear driving pattern, and enlarge or reduce it according to an area or length ratio of the designated area AD. As a result, the driving pattern may also be enlarged or reduced together with the virtual rectangular plane to be matched to an appropriate location within the designated area AD.

In addition, the robot cleaners 1 and 2 may set the driving pattern matched through the above process as the driving path of the robot cleaner 1 in the designated area AD. That is, the robot cleaner 1 may calculate the coordinates of the driving path in the designated area AD, and determine the location on the map and the location in the actual cleaning area to set the driving path of the robot cleaner 1.

The control method of the robot cleaners 1 and 2 according to the present invention may further include the step (S70) of determining a current location in response to the map when a cleaning command is input from the terminal 5, and moving to the designated area AD when the current location is determined.

The robot cleaner 1 may match the current location (O') information to the map of the robot cleaners 1 and 2, determine a relative location to the designated area AD set based on the map of the robot cleaners 1 and 2, and calculate a path to move to the designated area AD. In addition, the robot cleaners 1 and 2 may drive toward the designated area AD along the path.

In the case in which a specific point in the driving pattern is set as the driving (cleaning) start location, the robot cleaner 1 may additionally move to the driving start location after reaching the designated area AD.

On the other hand, unlike this, the robot cleaners 1 and 2 may determine the relative location to the designated area AD set based on a charging station O, and calculate a path capable of moving from the charging station O to the corresponding designated area AD. In addition, the robot cleaners 1 and 2 may start from the charging station O and drive along the path toward the designated area AD. In this case, unlike the case based on the robot cleaners 1 and 2 in motion, the location of the designated area AD can be calculated based on the stationary charging station O, so that the accuracy of path calculation can be improved.

On the other hand, unlike this, when information on the designated area AD (cleaning command) is newly received from the terminal while the robot cleaners 1 and 2 are driving in an area other than the designated area AD among the cleaning areas according to the previously input cleaning command, the robot cleaners 1 and 2 continue to drive according to the existing cleaning command, and drive within the designated area AD according to the newly input cleaning command when the robot cleaners 1 and 2 enter the newly entered designated area AD.

The control method of the robot cleaners 1 and 2 according to the present invention may include the step (S80) in which the robot cleaners 1 and 2 drive in the designated area AD.

When the robot cleaners 1 and 2 move from their existing locations and arrive at the designated area AD, they may drive according to the driving pattern set in the designated area AD. The robot cleaners 1 and 2 are capable of various driving such as straight driving, rotational driving, turning driving, and the like according to a set driving pattern.

Meanwhile, in the case in which a plurality of designated areas is set in order in the step (S10) of setting the designated area AD, the robot cleaners 1 and 2 may drive in the designated areas according to the input order. In this case, when a driving pattern is set for each designated area, the cleaners may drive according to the set driving pattern.

On the other hand, in the case in which a plurality of designated areas is designated for the plurality of robot cleaners 1 and 2 in the step (S10) of setting the designated area AD, each of the robot cleaners 1 and 2 may move to the designated area AD, drive within the designated area AD, and drive in the designated area AD in which other robot cleaner 1, 2 has driven when the driving in the corresponding designated area AD ends. For example, when a first designated area AD1 is designated for the first robot cleaner 1 and a second designated area AD2 is designated for the second robot cleaner 2, the first robot cleaner 1 can drive in the second designated area AD2 after driving in the first designated area AD1, and the second robot cleaner 2 can drive in the first designated area AD1 after driving in the second designated area AD2. With such a configuration, there is an effect that a plurality of areas can be cleaned at the same time.

Although the present invention has been described in detail through specific examples, it is intended to describe the present invention in detail, the present invention is not limited thereto, and it is clear that the present invention can be modified or improved by those of ordinary skill in the art within the technical spirit of the present invention.

All simple modifications or changes of the present invention fall within the scope of the present invention, and the specific scope of protection of the present invention will be made clear by the appended claims.

The invention claimed is:

1. A control system, comprising:

a robot cleaner configured to:

store a map including information on a drivable area of a cleaning area, and drive within the cleaning area; and a terminal configured to input a cleaning command to the robot cleaner, wherein the terminal is configured to display the cleaning area on the map and set a designated area in a form of a surface connecting a plurality of points, within the cleaning area in response to a user's touch input to the terminal, wherein the terminal is configured to display a plurality of divided areas on the map, to set the designated area so as to extend across at least two of the plurality of divided areas, and to allow the designated area to be set while passing through boundaries between the plurality of divided areas when the designated area is set across at least two of the plurality of divided areas, and wherein the robot cleaner is further configured to move to the designated area and drive within the designated area, in response to the designated area being set from the terminal.

2. The control system according to claim 1, wherein the terminal is further configured to display a plurality of driving patterns and set any one of the plurality of driving patterns, and wherein the robot cleaner is further configured to drive within the designated area according to the driving pattern set in the terminal.

3. The control system according to claim 1, wherein the terminal is further configured to set a driving pattern expressed as a line inside the designated area, and wherein the robot cleaner is further configured to drive within the designated area according to the driving pattern set by the terminal.

4. The control system according to claim 1, wherein the terminal is further configured to set a cleaning order in the plurality of divided areas, and wherein the robot cleaner is further configured to drive within the plurality of divided areas according to the cleaning order set by the terminal.

5. The control system according to claim 2, wherein the plurality of driving patterns are displayed on the terminal as separate pattern selection units and are spaced from the map, and wherein the setting of any one of the plurality of driving patterns is performed by the user pressing one of the pattern selection units on the terminal.

6. The control system according to claim 1, wherein the robot cleaner includes:

a body having a space accommodating a battery, a water container, and a motor;

a pair of rotation plates rotatably arranged on a bottom surface of the body, each rotation plate among the pair of rotation plates including a lower side coupled to a mop;

a suction cleaner including a dust inlet; and a pair of wheels.

* * * * *